US010381209B2

(12) United States Patent
Ouyang et al.

(10) Patent No.: US 10,381,209 B2
(45) Date of Patent: Aug. 13, 2019

(54) PROBES, SYSTEMS, CARTRIDGES, AND METHODS OF USE THEREOF

(71) Applicants: Purdue Research Foundation, West Lafayette, IN (US); Zheng Ouyang, West Lafayette, IN (US); Yue Ren, West Lafayette, IN (US); Xiao Wang, West Lafayette, IN (US)

(72) Inventors: Zheng Ouyang, West Lafayette, IN (US); Yue Ren, West Lafayette, IN (US); Xiao Wang, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 15/548,275

(22) PCT Filed: Feb. 8, 2016

(86) PCT No.: PCT/US2016/017010
§ 371 (c)(1),
(2) Date: Aug. 2, 2017

(87) PCT Pub. No.: WO2016/127177
PCT Pub. Date: Aug. 11, 2016

(65) Prior Publication Data

US 2018/0012746 A1 Jan. 11, 2018

Related U.S. Application Data

(60) Provisional application No. 62/211,268, filed on Aug. 28, 2015, provisional application No. 62/112,799, filed on Feb. 6, 2015.

(51) Int. Cl.
*H01J 49/04* (2006.01)
*H01J 49/16* (2006.01)

(52) U.S. Cl.
CPC ..... *H01J 49/0409* (2013.01); *H01J 49/0445* (2013.01); *H01J 49/167* (2013.01)

(58) Field of Classification Search
CPC ..... H01J 49/0409; H01J 49/0445
(Continued)

(56) References Cited

U.S. PATENT DOCUMENTS 3,334,233 A 8/1967 Veal
4,235,838 A 11/1980 Redmore et al.
(Continued)

FOREIGN PATENT DOCUMENTS

CN 101820979 A 9/2010
CN 102414778 A 4/2012
(Continued)

OTHER PUBLICATIONS

Ratcliffe et al., 2007, Surface Analysis under Ambient Conditions Using Plasma-Assisted Desorption/Ionization Mass Spectrometry, Anal. Chem., 79:6094-6101.
(Continued)

*Primary Examiner* — Nicole M Ippolito
*Assistant Examiner* — Hanway Chang
(74) *Attorney, Agent, or Firm* — Brown Rudnick LLP; Adam M. Schoen

(57) ABSTRACT

The invention generally relates to probes, systems, cartridges, and methods of use thereof. In certain embodiments, the invention provides a probe including a porous material and a hollow member coupled to a distal portion of the porous material.

18 Claims, 10 Drawing Sheets

(58) Field of Classification Search
USPC ..... 250/281, 282
See application file for complete search history.

(56) References Cited

U.S. PATENT DOCUMENTS

| | | | |
|---|---|---|---|
| 4,755,670 | A | 7/1988 | Syka et al. |
| 4,757,198 | A | 7/1988 | Korte et al. |
| 4,828,547 | A | 5/1989 | Sahi et al. |
| 4,885,076 | A | 12/1989 | Smith et al. |
| 4,957,640 | A | 9/1990 | Treybig et al. |
| 5,141,868 | A | 8/1992 | Shanks et al. |
| 5,152,177 | A | 10/1992 | Buck et al. |
| 5,160,841 | A | 11/1992 | Chapman et al. |
| 5,288,646 | A | 2/1994 | Lundsgaard et al. |
| 5,583,281 | A | 12/1996 | Yu |
| 5,798,146 | A | 8/1998 | Murokh et al. |
| 5,961,772 | A | 10/1999 | Selwyn |
| 6,297,499 | B1 | 10/2001 | Fenn |
| 6,452,168 | B1 | 9/2002 | McLuckey et al. |
| 6,465,964 | B1 | 10/2002 | Taguchi et al. |
| 6,477,238 | B1 | 11/2002 | Schneider et al. |
| 6,482,476 | B1 | 11/2002 | Liu |
| 6,627,881 | B1 | 9/2003 | Bertrand et al. |
| 6,645,399 | B2 | 11/2003 | Ahn et al. |
| 6,982,416 | B2 | 1/2006 | Villinger et al. |
| 6,992,284 | B2 | 1/2006 | Schultz et al. |
| 7,005,635 | B2 | 2/2006 | Ahern et al. |
| 7,010,096 | B1 | 3/2006 | Wooding |
| 7,135,689 | B2 | 11/2006 | Truche et al. |
| 7,154,088 | B1 | 12/2006 | Blain et al. |
| 7,171,193 | B2 | 1/2007 | Hoffman |
| 7,223,969 | B2 | 5/2007 | Schultz et al. |
| 7,259,019 | B2 | 8/2007 | Pawliszyn et al. |
| 7,335,897 | B2 | 2/2008 | Takats et al. |
| 7,384,793 | B2 | 6/2008 | McCash et al. |
| 7,384,794 | B2 | 6/2008 | Pawliszyn |
| 7,510,880 | B2 | 3/2009 | Gross et al. |
| 7,544,933 | B2 | 6/2009 | Cooks et al. |
| 7,564,027 | B2 | 7/2009 | Finch et al. |
| 7,651,585 | B2 | 1/2010 | Yoon et al. |
| 7,667,197 | B2 | 2/2010 | Lin et al. |
| 7,714,281 | B2 | 5/2010 | Musselman |
| 7,915,579 | B2 | 3/2011 | Chen et al. |
| 7,930,924 | B2 | 4/2011 | Krogh et al. |
| 8,030,088 | B2 | 10/2011 | McCash et al. |
| 8,076,639 | B2 | 12/2011 | Cooks et al. |
| 8,294,892 | B2 | 10/2012 | Sardashti et al. |
| 8,304,718 | B2 | 11/2012 | Ouyang et al. |
| 8,328,982 | B1 | 12/2012 | Babayan et al. |
| 8,330,119 | B2 | 12/2012 | Chen et al. |
| 8,334,505 | B2 | 12/2012 | Robinson et al. |
| 8,421,005 | B2 | 4/2013 | Musselman |
| 8,481,922 | B2 | 7/2013 | Musselman |
| 8,519,354 | B2 | 8/2013 | Charipar et al. |
| 8,704,167 | B2 | 4/2014 | Cooks et al. |
| 8,710,437 | B2 | 4/2014 | Cooks et al. |
| 8,754,365 | B2 | 6/2014 | Krechmer et al. |
| 8,772,710 | B2 | 7/2014 | Ouyang et al. |
| 8,816,275 | B2 | 8/2014 | Ouyang et al. |
| 8,859,956 | B2 | 10/2014 | Ouyang et al. |
| 8,859,958 | B2 | 10/2014 | Ouyang et al. |
| 8,859,959 | B2 | 10/2014 | Ouyang et al. |
| 8,859,986 | B2 | 10/2014 | Cooks et al. |
| 8,895,918 | B2 | 11/2014 | Cooks et al. |
| 8,932,875 | B2 | 1/2015 | Cooks et al. |
| 9,165,752 | B2 | 10/2015 | Cooks et al. |
| 2002/0034827 | A1 | 3/2002 | Singh et al. |
| 2002/0055184 | A1 | 5/2002 | Naylor et al. |
| 2002/0123153 | A1 | 9/2002 | Moon et al. |
| 2003/0136918 | A1 | 7/2003 | Hartley |
| 2003/0141392 | A1 | 7/2003 | Nilsson et al. |
| 2003/0180824 | A1 | 9/2003 | Mpock et al. |
| 2003/0199102 | A1 | 10/2003 | Ostrup |
| 2004/0011954 | A1 | 1/2004 | Park |
| 2004/0075050 | A1 | 4/2004 | Rossier et al. |
| 2004/0245457 | A1 | 12/2004 | Granger et al. |
| 2005/0072917 | A1 | 4/2005 | Becker |
| 2005/0112635 | A1 | 5/2005 | Gentle et al. |
| 2005/0117864 | A1 | 6/2005 | Dziekan et al. |
| 2005/0247870 | A9 | 11/2005 | Park |
| 2006/0093528 | A1 | 5/2006 | Banerjee et al. |
| 2006/0118713 | A1 | 6/2006 | Matsui et al. |
| 2006/0192107 | A1 | 8/2006 | Devoe et al. |
| 2006/0200316 | A1 | 9/2006 | Kanani et al. |
| 2006/0249668 | A1 | 11/2006 | Goldberg et al. |
| 2007/0003965 | A1 | 1/2007 | Ramsay et al. |
| 2007/0025881 | A1 | 2/2007 | Thompson et al. |
| 2007/0042418 | A1 | 2/2007 | Yehiely et al. |
| 2007/0042962 | A1 | 2/2007 | Adams et al. |
| 2007/0054848 | A1 | 3/2007 | Tohyama et al. |
| 2007/0059747 | A1 | 3/2007 | Bastian et al. |
| 2007/0108910 | A1 | 5/2007 | Eden et al. |
| 2007/0114389 | A1 | 5/2007 | Karpetsky et al. |
| 2007/0151232 | A1 | 7/2007 | Dalla Betta et al. |
| 2007/0187589 | A1 | 8/2007 | Cooks et al. |
| 2007/0228271 | A1 | 10/2007 | Truche et al. |
| 2007/0278401 | A1 | 12/2007 | Finlay |
| 2008/0067352 | A1 | 3/2008 | Wang |
| 2008/0083873 | A1 | 4/2008 | Giardina |
| 2008/0128608 | A1 | 6/2008 | Northen et al. |
| 2008/0179511 | A1 | 7/2008 | Chen et al. |
| 2008/0193330 | A1 | 8/2008 | Hotta et al. |
| 2008/0193772 | A1 | 8/2008 | Agroskin et al. |
| 2008/0210856 | A1 | 9/2008 | Eide et al. |
| 2008/0272294 | A1 | 11/2008 | Kovtoun |
| 2008/0277579 | A1 | 11/2008 | Lin et al. |
| 2008/0283742 | A1 | 11/2008 | Takeuchi et al. |
| 2008/0315083 | A1 | 12/2008 | Lubda et al. |
| 2009/0065485 | A1 | 3/2009 | O'Neill et al. |
| 2009/0071834 | A1 | 3/2009 | Hafeman et al. |
| 2009/0090856 | A1 | 4/2009 | Grant et al. |
| 2009/0127454 | A1 | 5/2009 | Ritchie et al. |
| 2009/0152371 | A1 | 6/2009 | Stark et al. |
| 2009/0188626 | A1 | 7/2009 | Lu et al. |
| 2009/0280300 | A1 | 11/2009 | Craighead et al. |
| 2009/0306230 | A1 | 12/2009 | Semikhodskii et al. |
| 2009/0309020 | A1 | 12/2009 | Cooks et al. |
| 2010/0001181 | A1 | 1/2010 | Moini |
| 2010/0019143 | A1 | 1/2010 | Dobson et al. |
| 2010/0019677 | A1 | 1/2010 | Kitano et al. |
| 2010/0035245 | A1 | 2/2010 | Stiene et al. |
| 2010/0059689 | A1 | 3/2010 | Horiike et al. |
| 2010/0108879 | A1 | 5/2010 | Bateman et al. |
| 2010/0230587 | A1 | 9/2010 | Marshall et al. |
| 2010/0266489 | A1 | 10/2010 | Rauleder et al. |
| 2010/0301209 | A1 | 12/2010 | Ouyang et al. |
| 2011/0108724 | A1 | 5/2011 | Ewing et al. |
| 2011/0108726 | A1 | 5/2011 | Hiraoka et al. |
| 2011/0133077 | A1 | 6/2011 | Henion et al. |
| 2011/0193027 | A1 | 8/2011 | Mackenzie et al. |
| 2011/0210265 | A1 | 9/2011 | Lozano et al. |
| 2012/0018629 | A1 | 1/2012 | Eikel et al. |
| 2012/0119079 | A1 | 5/2012 | Ouyang et al. |
| 2012/0153139 | A1 | 6/2012 | Qian et al. |
| 2012/0199735 | A1 | 8/2012 | Krechmer et al. |
| 2012/0326022 | A1 | 12/2012 | Kumano et al. |
| 2013/0023005 | A1 | 1/2013 | Chen et al. |
| 2013/0112017 | A1 | 5/2013 | Ouyang et al. |
| 2013/0112866 | A1 | 5/2013 | Ouyang et al. |
| 2013/0112867 | A1 | 5/2013 | Ouyang et al. |
| 2013/0273560 | A1 | 10/2013 | Cooks et al. |
| 2013/0299694 | A1 | 11/2013 | Sato et al. |
| 2014/0008529 | A1 | 1/2014 | Ouyang et al. |
| 2014/0008532 | A1 | 1/2014 | Ouyang et al. |
| 2014/0048697 | A1 | 2/2014 | Cooks et al. |
| 2014/0054809 | A1 | 2/2014 | Lozano et al. |
| 2014/0165701 | A1 | 6/2014 | Wu et al. |
| 2014/0183351 | A1 | 7/2014 | Cooks et al. |
| 2014/0299764 | A1 | 10/2014 | Ouyang et al. |

FOREIGN PATENT DOCUMENTS

| | | | |
|---|---|---|---|
| JP | 2011-007690 | A | 1/2011 |
| WO | 2001/053819 | A1 | 7/2001 |

(56) References Cited

FOREIGN PATENT DOCUMENTS

| | | | |
|---|---|---|---|
| WO | 2001/086306 | A2 | 11/2001 |
| WO | 2003/027682 | A2 | 4/2003 |
| WO | 2003/104814 | A2 | 12/2003 |
| WO | 2004/060278 | A2 | 7/2004 |
| WO | 2006/039456 | A1 | 4/2006 |
| WO | 2008/065245 | A1 | 6/2008 |
| WO | 2009/023361 | A2 | 2/2009 |
| WO | 2009/134439 | A2 | 11/2009 |
| WO | 2010/127059 | A1 | 11/2010 |
| WO | 2012/094227 | A2 | 7/2012 |
| WO | 2012/170301 | A1 | 12/2012 |
| WO | 2014/120411 | A1 | 8/2014 |
| WO | 2015/126595 | A1 | 8/2015 |

OTHER PUBLICATIONS

Rauschenbach, et al., "Electrospraylon Beam Deposition of Clusters and Biomolecules", Small 2006, 2, 540-547.
Regenthal, M. Krueger, C. Koeppel and R. Preiss, J. Clin. Monitor Comp., 1999, 15, 529-544.
Ren, Yue et al., "Direct Mass Spectrometry Analysis of Untreated Samples Ultralow Amounts Using Extraction Nano-Electrospray", Analytical Methods, vol. 5, No. 23, Sep. 20, 2013, pp. 6686-6692 (7 Pages).
Roach et al., Analyst, 2010, 135, 2233-2236.
Rohle, D., et al., An Inhibitor of Mutant IDH1 Delays Growth and Promotes Differentiation of Glioma Cells, Science 340:626-630 (2013), published in USA.
Ronn, A. M.; Lemnge, M. M.; Angelo, H. R.; Bygbjerg, I. C.; Therap. Drug Monitor., 1995, 17, 79-83.
Rosch, Journal of bacteriology, 2007, 189, 801-806.
Rosi, C. A. Mirkin, "Nanostructures in biodiagnostics." Chem. Rev. 2005, 105, 1547-1562.
Saint-Marcoux, F.; Sauvage, F.-L.; Marquet, P.; Anal. Bioanal. Chem., 2007, 388, 1327-1349.
Santos et al., Brazilian Journal of Infectious Diseases, 2003, 7, 297-300.
Schwamborn K, et al., (2007), Identifying prostate carcinoma by MALDI-Imaging, International Journal of Molecular Medicine 20(2)155-159, published in Germany.
Search Report and Written Opinion dated Aug. 27, 2014 for PCT/US14/34767.
Search Report and Written Opinion dated Aug. 4, 2010 for PCT/US2010/032881.
Search Report and Written Opinion dated Jul. 8, 2014 for PCT/US2014/012746.
Search Report dated Oct. 29, 2012 for PCT/US2012/040521.
Shevchenko, E. V.; Talapin, D. V.; Kotov, N. A.; O'Brien, S.; Murray, C. B.: Structural Diversity in Binary Nanoparticle Superlattices. Nature 439, 55-59.(2006).
Shiea et al., Electrospray-assisted laser desorption/ionization mass spectrometry for direct ambient analysis of solids, J. Rapid Communications in Mass Spectrometry, 19:3701-3704, 2005, published in USA.
Shulman et al., Clinical Infectious Diseases, 2012, 55, e86-e102.
Sokol et al., 2011, Miniature mass spectrometer equipped with electrospray and desorption electrospray ionization for direct analysis of organics from solids and solutions, Int. J. Mass Spectrum. 306:187-195.
Soparawalla et al., Analyst, 2011, 136, 4392-4396.
Spooner, N.; Lad, R.; Barfield, M. Anal. Chem., 2009, 81, 1557-1563.
Stiles et. al. "Surface-enhanced Raman spectroscopy." Annu. Rev. Anal. Chem. 1, 601-26, 2008.
Stockle, Y. D. Suh, V. Deckert, R. Zenobi, Chem. Phys. Lett. 2000, 318, 131-136.
Su et al., "Quantitative Paper Spray Mass Spectrometry Analysis of Drugs of Abuse", The Analyst, vol. 138, No. 16, Jan. 1, 2013, p. 4443 (5 Pages).
Suyagh, M.F.; Laxman, K. P.; Millership, J.; Collier, P.; Halliday, H.; McElnay, J. C., J. Chromatogr. B Analyt. Technol. Biomed. Life Sci., 2010, 878, 769-776.
Sylvestre, J. P.; Kabashin, A. V.; Sacher, E.; Meunier, M.: Femtosecond Laser Ablation of Gold in Water: Influence of the Laser-Produced Plasma on the Nanoparticle Size Distribution. Applied Physics a—Materials Science & Processing 30, 753-758.(2005).
Tachi, T. Hase, Y. Okamoto, N. Kaji, T. Arima, H. Matsumoto, M. Kondo, M. Tokeshi, Y. Hasegawa and Y. Baba, Anal. 5 Bioanal. Chem., 2011, 401, 2301-2305.
Takats et al., Journal of Mass Spectrometry, 2005, 40, 1261-1275.
Takats et al., Mass spectrometry sampling under ambient conditions with desorption electrospray ionization, Science 306, 471-473 (2004), published in USA.
Tanaka et al., Protein and Plymer Analyses up to m/z 100 000 by Laser Ionization Time-of-Flight Mass Spectrometry, Rapid Commun. Mass Spectrom., 2:151-153,1988, published in United Kingdom.
Tawa, R.; Hirose, S.; Fujimoto, T.; J. Chromatogr. B: Biomed. Appl. 1989, 490, 125-132.
Taylor, P. J.; Tai, C.-H.; Franklin, M. E.; Pillans, P. I.; Clin. Biochem., 2011, 44, 14-20.
Thibodeaux et al., "Marine Oil Fate: Knowledge Gaps, Basic Research, and Development Needs; a Perspective based on the Depwater Horizon Spill" Environmental Engineering Science, 2011, 28, 87-93.
Tian, Z. X.; Kass, S. R.; J. Am. Chem. Soc., 2008, 130, 10842-1084.
Turcan, S., et al., IDH1 mutation is sufficient to establish the glioma hypermethylator phenotype, Nature 483, 179-483 (2012), published in USA.
Valadon, L. R. G.; Mummery, R. S.; Phytochemistry, 1972, 11, 413-414.
Valentine, et al., "Propane respiration jump-starts microbial response to deep oiil spill", Science, 2010, 330(208-211).
Van Berkel, G.J., et al., Established and emerging atmospheric pressure surface sampling/ionization techniques for mass spectrometry, J Mass Spectrom 43, 1161-1180 (2008), published in USA.
Venter et al., Analytical Chemistry, 2013, 86, 233-249.
Venter, A. R.; Kamali, A.; Jain, S.; Bairu, S.; Anal. Chem., 2010, 82, 1674-1679.
Vivekanadan-Giri et al., 2008, Mass spectrometric quantification of amino acid oxidation products identifies oxidative mechanisms of diabetic end-organ damage, Rev. Endocr. Metab. Disord., 9(4):275-287.
Wang et al., "Paper Spray for Direct Analysis of Complex Mixtures Using Mass Spectrometry." Angewandte Chemie, 2010, 49, 877-880.
Wang, F., et al., Targeted Inhibition of Mutant IDH2 in Leukemia Cells Induces Cellular Differentiation, Science 340:622-625 (2013), published in USA.
Wang, et al., Anal. Chem., 2011, 83, 1197-1201.
Wang, et al., Anal. Chem. 2014, 86, 3338-3345.
Wang, Z. D. Schultz, "The Chemical Origin of Enhanced Signals From Tip-Enhanced Raman Detection of Functionalized Nanoparticles" Analyst 2013, 138, 3150-3157.
Weller, M., et al., A. Isocitrate dehydrogenase mutations: a challenge to traditional views on the genesis and malignant progression of gliomas, Glia 59, 1200-1204 (2011), published in USA.
Wertz et al., Comparative Biochemistry and Physiology Part B: Comparative Biochemistry, 1986, 83, 529-531.
Wiley et al., Analyst, 2010, 135, 971-979.
Cyriac,et al., "Low-Energy Ionic Collisions at Molecular Solids", Chem. Rev. 2012, 112, 5356-5411.
Dang, L., et al., Cancer-associated IDH1 mutations produce 2-hydroxyglutarate, Nature 462, 739-744 (2009), published in USA.
Dempsey, P. Tutka, P. Jacob, F. Allen, K. Schoedel, R. F. Tyndale, N. L. Benowitz, Clin. Pharmacal. Ther., 2004, 76, 64-72.
Dessi et al., "Cholesterol Content in Tumor Tissues Is Inversely Associated with High-Density Lipoprotein Cholesterol in Serum in Patients with Gastrointestinal Cancer", Cancer, Jan. 15, 1994, vf. 73, No. 2, pp. 253-258.
Dettmer at al., "Mass Spectrometry-Based Metabolomics". Mass Spectrom. Rev., 2007, v. 26, No. 1, pp. 51-78.

(56) References Cited

OTHER PUBLICATIONS

Rias-Santagata, D., et al., Braf V600E mutations are common in pleomorphic xanthoastrocytoma: diagnostic and therapeutic implications, PLoS One 6, e17948 (2011), published in USA.
Dias-Santagata, D., et al., Rapid targeted mutational analysis of human tumours: a clinical platform to guide personalized cancer medicine. EMBO Mol Med 2, 146-158 (2010), published in Germany.
Dieringer et al. "Surface-enhanced Raman excitation spectroscopy of a single rhodamine 6G molecule." J. Am. Chem. Soc. 131, 849-54, 2009.
Dill, A.L., et al., Lipid profiles of canine invasive transitional cell carcinoma of the urinary bladder and adjacent normal tissue by desorption electrospray ionization imaging mass spectrometry, Anal Chem 81, 8758-8764 (2009), published in USA.
Dill, A.L., et al., Multivariate statistical differentiation of renal cell carcinomas based on lipidomic analysis by ambient ionization imaging mass spectrometry, Analytical and Bioanalytical Chemistry 398, 2969-2978 (2010), published in Germany.
Dill, A.L., et al., Multivariate Statistical Identification of Human Bladder Carcinomas Using Ambient Ionization Imaging Mass Spectrometry, A European Journal 17, 2897-2902 (2011), published in Germany.
Eberlin et al. (Angewandte Chemie International Edition, 2010, 49, 873-876).
Eberlin, L.S. et al., Cholesterol Sulfate Imaging in Human Prostate Cancer Tissue by Desorption Electrospray Ionization Mass Spectrometry, Analytical Chemistry 82, 3430-3434 (2010), published in USA.
Eberlin, L.S., et al., Ambient mass spectrometry for the intraoperative molecular diagnosis of human brain tumors, Proc Natl Acad Sci USA 110(5)1611-1616 (2013), published in USA.
Eberlin, L.S., et al., Classifying human brain tumors by lipid imaging with mass spectrometry, Cancer Res 72, 645-654 (2012), published in USA.
Eberlin, L.S., et al., Discrimination of human astrocytoma subtypes by lipid analysis using desorption electrospray ionization imaging mass spectrometry, Angew Chem Int Ed Engl 49, 5953-5956 (2010), published in Germany.
Eberlin, L.S., et al., Nondestructive, histologically compatible tissue imaging by desorption electrospray ionization mass spectrometry, ChemBioChem 12, 2129-2132 (2011), published in Germany.
Eckert et al., "Chemical Characterization of Crude Petroleum Using Nanospray Desorption Eelectrospray Ionization Coupled With High-Resolution Mass Spectrometry", Analytical Chemistry, 2011 (9 Pages).
Egan, R. W.; Anal Biochem., 1975, 68, 654-657.
Elhawary, H., et al., Intraoperative real-time querying of white matter tracts during frameless stereotactic neuronavigation, Neurosurgery 68, 506-516; Discussion 516 (2011), published in USA.
Elkhaled, A., et al., Magnetic resonance of 2-hydroxyglutarate in IDH1-mutated low-grade gliomas, Science Translational Medicine 4, 116ra115 (2012), published in USA.
Ellis et al., Imaging of Human Lens Lipids by Desorption Electrospray Ionization Mass Spectrometry, J. Am. Soc. Mass Spectrom. 21(12):2095-2104, published in USA.
Espy et al., The Analyst, 2012, 137, 2344-2349.
Eustis, M. A. El-Sayed, "Why gold nanoparticles are more precious than pretty gold: noble metal surface plasmon resonance and its enhancement of the radiative and nonradiative properties of nanocrystals of different shapes" Chem. Soc. Rev. 2006, 35, 209-217.
Evans and H. L. McLeod, N. Engl. J. Med., 2003, 348, 538-549.
Evans and M. V. Relling, Nature, 2004, 429, 464-468.
Evans and M. V. Relling, Science, 1999, 286, 487-491.
Extended European Search Report dated Oct. 18, 2016 for European Patent Application No. 14818223.1 (5 Pages).
Extended European Search Report dated Sep. 7, 2016 for European Patent Application No. 14745610.7 (11 Pages).
Fang, et al. "Measurement of the distribution of site enhancements in surface-enhanced Raman scattering", Science 2008, 321, 388-392.
Faraday, M.: The Bakerian Lecture: Experimental Relations of Gold (and Other Metals) to Light. Philosophical Transactions of the Royal Society of London 147, 145-181.(1857).
Fenn et al., 1989, Electrospray Ionization for Mass Spectrometry of Large Biomolecules, Science 246:64-71, published in USA.
Ferguson et al., Direct Ionization of Large Proteins and Protein Complexes by Desorption Electrospray Ionization-Mass Spectrometry, Anal. Chem. 2011, 83, 6468-6473.
Fiore, Med. Clin. N. Am., 1992, 76, 289-303.
Fox et al., Journal of clinical microbiology, 2006, 44, 3918-3922.
Fujimoto, T.; Tsuda, Y.; Tawa, R.; Hirose, S.; Clin. Chem., 1989, 35, 867-869.
Gao et al., "Design anc Characterization of a Multisource Hand-Held Tandem Mass Spectrometer", Z. Anal. Chem. 2008, 80, pp. 7198-7205.
Gao, et al. "Handheld Rectilinear Ion Trap Mass Spectrometer" Anal. Chem. 2006, 78, pp. 5994-6002.
Gao, L.; Cooks, R. G.; Ouyang, Z.; Anal. Chem., 2008, 80, 4026-4032.
Gaskell, "Electrospray: Principles and Practice." J. Mass. Spect., vol. 32, 677-688 (1997).
Genov, A. K. Sarychev, V. M. Shalaev, A. Wei, "Resonant Field Enhancements from Metal Nanoparticles Arrays," Nano Lett. 2004, 4, 153-158.
Gerber et al., Clinical microbiology reviews, 2004, 17, 571-580.
Gerlowski and R. K. Jain, J. Pharm. Sci., 1983, 72, 1103-1127.
Gieseker et al., Pediatrics, 2003, 111, e666-e670.
Giljohann, D. A.; Seferos, D. S.; Daniel, W. L.; Massich, M. D.; Patel, P. C.; Mirkin, C. A.: Gold Nanoparticles for Biology and Medicine. Angew. Chem., Int. Ed. 49, 3280-3294.(2010).
Gonzalez-Serrano et al., PloS One, 2013, 8, e74981.
Gough et al. "Analysis of Oilfield Chemicals by Electrospray Mass Spectrometry", Rapid Communications in Mass Spectrometry, 1999 (10 Pages).
Gough et al., "Molecular Monitoring of Residual Corrosion Inhibitor Actives in Oilfields Fluids: Implications for Inhibitor Performance" Corrosion, 98 Paper No. 33 (1998) (12 Pages).
Greeneltch, et al. "Immobilized Nanorod Assemblies: Fabrication and Understanding of Large Area Surface-Enhanced Raman Spectroscopy Substrates", Anal. Chem. 2013, 85, 2297-2303.
Guo, J., et al., The relationship between Cho/NAA and glioma metabolism: implementation for margin delineation of cerebral gliomas, Acta Neurochir (Wien) 154, 1361-1370; Discussion 1370 (2012), published in USA.
Abe, et al. "Inkjet-Printed Microfluidic Multianalyte Chemical Sensing Paper," Anal. Chem. 2008, 80, pp. 6928-6934.
Agar, et al. Development of stereotactic mass spectrometry for brain tumor surgery, Neurosurgery 68, 280-289; Discussion 290 (2011), published in USA.
Ahmadi, T. S.; Wang, Z. L.; Green, T. C.; Henglein, A.; ElSayed, M. A.: Shape-Controlled Synthesis of Colloidal Platinum Nanoparticles. Science 272, 1924-1926.(1996).
Allgeier, A. M.; Mirkin, C. A.: Ligand Design for Electrochemically Controlling Stoichiometric and Catalytic Reactivity of Transition Metals. Angew. Chem., Int. Ed. 37, 894-908.(1998).
Arnary, et al., IDH1 and IDH2 mutations are frequent events in central chondrosarcoma and central and periosteal chondromas but not in other mesenchymal tumours, J Pathol 224, 334343 (2011).
Amoruso, S.; Ausanio, G.; Bruzzese, R.; Vitiello, M.; Wang, X.: Femtosecond Laser Pulse Irradiation of Solid Targets as a General Route to Nanoparticle Formation in a Vacuum. Phys. Rev. B 71.(2005).
Andronesi, et al., Detection of 2-hydroxyglutarate in IDH-mutated glioma patients by in vivo spectral-editing and 2D correlation magnetic resonance spectroscopy, Sci Transl Med 4, 116ra114 (2012).
Asiala, et al. "Characterization of Hotspots in a Highly Enhancing SERS Substrate", Analyst 2011, 136, 4472-4479.
Aston Labs report "Histologically compatible tissue imaging", published May 6, 2009.

(56) References Cited

OTHER PUBLICATIONS

Atlas, et al., "Oil biodegradation and bioremediation: a tale of the two worst spilss in U.S. history" Environmental Science & Technology, 2011,45,6709-6715.
Badu-Tawiah et al, "Ambient ion soft landing.", Anal. Chem. 2011, 83, 2648-2654.
Badu-Tawiah et al., Annual Review of Physical Chemistry, 2013.
Badu-Tawiah, et al. "Peptide Cross-Linking at Ambient Surfaces by Reactions of Nanosprayed Molecular Cations" , Angew. Chem. 2012, 124, 9551-9555.
Badu-Tawiah, et al. Journal of the American Society for Mass Spectrometry, 2010, 21, 1423-1431.
Baer, et al. "Surface characterization of nanomaterials and nanoparticles: Important needs and challenging opportunities:", Journal of Vacuum Science & Technology A 2013, 31.
Baird, W. P. Peng, R. G. Cooks, "Ion transport and focal properties of an ellipsoidal electrode operated at atmospheric pressure" Int. J. Mass Spectrom. 2012, 330, 277-284.
Barfield, et al., Chromatogr. B Analyt. Technol. Biomed. Life Sci., 2008, 870, 32-37.
Baumann, et al., Chromatogr B878, 107, Jan 1, 2010.
Benowitz, Annu. Rev. Pharmacol. Toxicol., 2009, 49, 57-71.
Benowitz, et al., Nicotine & Tobacco Research, 2003, 5, 621-624.
Benowitz, N. Engl. J. Med., 2010, 362, 2295-2303.
Bergeron et al., New England Journal of Medicine, 2000, 343, 175-179.
Biggs,et al. "Two-dimensional stimulated resonance Raman spectroscopy of molecules with broadband x-ray pulses ", J. Chem. Phys. 2012, 136.
Bisno, New England Journal of Medicine, 2001, 344, 205-211.
Bootharaju et al., Rsc Advances 2, 10048, 2012.
Borger, et al., Frequent mutation of isocitrate dehydrogenase (IDH)1 and IDH2 in cholangiocarcinoma identified through broad-based tumor genotyping, Oncologist 17, 72-79 (2012).
Breadmore, M. C.; Theurillat, R.; Thormann, W.; Electrophoresis, 2004, 25, 1615-1622.
Bruzewicz et al. "Low-Cost Printing of Poly(dimethylsiloxane) Barriers to Define Microschannels in Paper," Anal. Chem. 2008, 80, pp. 3387-3392.
Campbell et al., Advanced Techniques in Diagnostic Microbiology, Springer, 2013, pp. 31-51.
Camurdan et al., International journal of pediatric otorhinolaryngology, 2008, 72, 1203-1206.
Capper, et al., Characterization of R132H mutation-specific IDH1 antibody binding in brain tumors, Brain Pathol 20, 245-254 (2010).
Carroll et al., 1975, Atmospheric Pressure Ionization Mass Spectrometry: Corona Discharge Ion Source for Use in Liquid Chromatograph-Mass Spectrometer-Computer Analytical System, Anal. Chem. 47:2369-2373, published in USA.
Castegna et al., "Proteomic identification of oxidatively modified proteins in Alzheimer's disease brain. Part 1: Creatine kinase BB, glutamine synthase, and ubiquitin carboxy-terminal hydrolase L-1", Free Radical Biology and Medicine, Elsevier Science, US, vol. 33, No. 4, Aug. 15, 2002 (Aug. 15, 2002), pp. 562-571, XP009169551, ISSN: 0891-5849.
Centers for Disease Control and Prevention. Smoking-Attributable Mortality, Years of Potential Life Lost, and Productivity Losses—United States, 2000-2004. Morbidity and Mortality Weekly Report; 2008; 57(45):1226-8.
Centers for Disease Control and Prevention. Vital Signs: Current Cigarette Smoking Among Adults Aged 18 Years—United States, 2005-2010. Morbidity and Mortality Weekly Report 2011; 60(33):1207-12.
Chakraborty, S. Bag, U. Landman, T. Pradeep, Journal of Physical Chemistry Letters 2013, 4, 2769-2773.
Chaurand et al., "Assessing Protein Patterns in Disease Using Imaging Mass Spectrometry", J. Proteome Res., 2004, v. 3, pp. 245-252.
Checa, A.; Oliver, R.; Hernandez-Cassou, S.; Saurina, J.; Anal. Chim. Acta, 2009, 647, 1-13.
Chen et al., Journal of the American Society for Mass Spectrometry, 2009, 20, 1947-1963.
Cheung, C. Y.; van der Heijden, J.; Hoogtanders, K.; Christiaans, M.; Liu, Y. L.; Chan, Y. H.; Choi, K. S.; van de Plas, A.; Shek, C. C.; Chau, K. E; Li, C. S.; van Hoof, J.; Stalk, L.; Transplant Int., 2008, 21, 140-145.
Chi, A.S., et al., Prospective, high-throughput molecular profiling of human gliomas, J Neurooncol 110, 89-98 (2012), published in USA.
Choi C. et al., 2-hydroxyglutarate detection by magnetic resonance spectroscopy in IDH-mutated patients with gliomas, Nat Med 18, 624-629 (2012), published in USA.
Claydon et al. "The Rapid Identification of Intact Microorganisms Using Mass Spectrometry", Nature Biotechnology, vol. 14, No. 11, Nov. 1, 1996, pp. 1584-1586 (3 Pages).
Clerc et al., Clinical Microbiology and Infection, 2010, 16, 1054-1061.
Hadjar,et al. "IonCCD™ for direct position-sensitive charged-particle detection: from electrons and keV ions to hyperthermal biomolecular ions." , J. Am. Soc. Mass Spectrom. 2011, 22, 612-623.
Hao, G. C. Schatz, "Electromagnetic fields around silver nanoparticles and dimers." J. Chem. Phys. 2004, 120, 357-366.
Harris, G.A., et al., Ambient sampling/ionization mass spectrometry: applications and current trends, Analytical Chemistry 83, 4508-4538 (2011), published in USA.
Hartmann, C., et al., Type and frequency of IDH1 and IDH2 mutations are related to astrocytic and oligodendroglial differentiation and age: a study of 1,010 diffuse gliomas, Acta Neuropathol 118, 469-474 (2009), published in USA.
Havlicek et al., Analytical Chemistry, 2012, 85, 790-797.
Heine, R.; Rosing, H.; van Gorp, E. C. M.; Mulder, J. W.; van der Steeg, W. A.; Beijnen, J. H.; Huitema, A. D. R.; J. Chromatogr. B: Analyt. Technol. Biomed. Life Sci., 2008, 867, 205-212.
Henningfield, N. Engl. J. Med., 1995, 333, 1196-1203.
Hiraoka et al., Rapid Communications in Mass Spectrometry, 2007, 21, 3139-3144.
Holford and L. B. Sheiner, Clin Pharmacokinet, 1981, 6, 429-453.
Hou et al., "Sampling Wand for an Ion Trap Mass Spectrometer" Anal. Chem, 2011, 83, pp. 1857-1861.
Huang et al., 2010, Ambient Ionization Mass Spectrometry, Ann. Rev. Anal. Chem., 3:43-65.
Hukkanen, P. Jacob, N. L. Benowitz, Pharmacol. Rev., 2005, 57, 79-115.
Hulteen, R. P. Vanduyne,"Nanosphere Litography: A materials general fabrication process for periodic particle array surfaces" J. Vac. Sci. Technol. A 1995, 13, 1553-1558.
Iavarone, A. T.; Jurchen, J. C.; Williams, E. R.; J. Am. Soc. Mass Spectrom., 2000, 11, 976-985.
Iavarone, O. A. Udekwu, E. R. Williams, Anal. Chem., 2004, 76, 3944-3950.
Ifa et al., Desorption electrospray ionization and other ambient ionization methods: current progress and preview, Analyst 135, 669-681 (2010), published in United Kingdom.
Ifa et al., Latent Fingerprint Chemical Imaging by Mass Spectrometry, Int. J. Mass Spectrom. 259(8):805, 2007, published in USA.
IPRP dated Aug. 4, 2015 for PCT/US2014/011000.
IPRP dated Dec. 10, 2011 for PCT/US2010/032881.
IPRP dated Dec. 19, 2013 for PCT/US2012/040521.
IPRP dated Dec. 9, 2010 for PCT/US2009/045649.
IPRP dated Jan. 7, 2016 for PCT/US2014/034767.
Jackson et al,, Journal of the American Society for Mass Spectrometry, 2007, 18, 2218-2225.
Jacob, D. Hatsukami, H. Severson, S. Hall, L. Yu, N. L. Benowitz, Cancer Epidemiol. Biomark. Prev., 2002, 11, 1668-1673.
Jacob, L. S. Yu, M. J. Duan, L. Ramos, O. Yturralde, N. L. Benowitz, Journal of Chromatography B—Analytical Technologies in the Biomedical and Life Sciences, 2011, 879, 267-276.
Jacob, L. Yu, A. T. Shulgin, N. L. Benowitz, Am. J. Public Health 1999, 89, 731-736.
Jain, X. H. Huang, I. H. El-Sayed, M. A. El-Sayed, "Noble metals on the nanoscale: optical and photothermal properties and some applications in imaging, sensing, biology, and medicine." Acc. Chem. Res. 2008, 41, 1578-1586.

(56) References Cited

OTHER PUBLICATIONS

Jarvis, H. Tunstallpedoe, C. Feyerabend, C. Vesey, Y. Saloojee, Am. J. Public Health, 1987, 77, 1435-1438.
Jeanmaire, R. P. Van Duyne, Journal of Electroanalytical Chemistry and Interfacial Electrochemistry 1977, 84, 1-20.
Jensen, M. D. Malinsky, C. L. Haynes, R. P. Van Duyne, J Phys Chem B 2000, 104, 10549-10556.
Jjunji et al., "In Situ Analysis of Corrosion Inhibitors Using a Portable Mass Spectrometer with Paper Spray Ionization", Analyst, 138,3740, first published on-line May 9, 2013 (10 Pages).
Johnson,et al., "Coverage-Dependent Charge Reduction of Cationic Gold Clusters on Surfaces Prepared Using Soft Landing of Mass-Selected Ions", J. Phys. Chem. C 2012, 116, 24977-24986.
Jolesz, F.A., Intraoperative imaging in neurosurgery: Where will the future take us? Acta Neurochir Suppl 109, 21-25 (2011), published in USA.
Joyce, Special Report: Glassware, Plasticware Compete in Labs, May 27, 1991, The Scientist Magazine.
Ju, Y. Yamagata, T. Higuchi, "Thin-Film Fabrication Method for Organic Light-Emitting Diodes Using Electrospray Deposition" Adv. Mater. 2009, 21, 4343-4347.
Kalinina, J., et al., Detection of "oncometabolite" 2-hydroxyglutarate by magnetic resonance analysis as a biomarker of IDH1/2 mutations in glioma, J Mol Med (Berl) 90, 1161-1171 (2012), published in Germany.
Katz et al., 1985, Synthesis and secretion of hemopexin in primary cultures of rat hepatocytes Demonstration of an intracellular prIKHD-of hemopexin, Eur. J. Biochem., 146:155-159.
Kebarle, P.; Tang, L.; Anal. Chem., 1993, 65, A972-A986.
Khairallah, G. N.; O'Hair, R. A.: Gas-Phase Synthesis of [Ag4h]+ and Its Mediation of the C—C Coupling of Allyl Bromide. Angew. Chem. Int. Ed. Engl. 44, 728-731.(2005).
Kim, M. A. Huestis, J. Mass Spectrom., 2006, 41, 815-821.
Kim, Y. Yamagata, B. J. Kim, T. Higuchi, Journal of Micromechanics and Microengineering 2009, 19.
Kleinman et al. "Single-molecule surface-enhanced Raman spectroscopy of crystal violet isotopologues: theory and experiment." J. Am. Chem. Soc. 133, 4115-22, 2011.
Kneipp, et al. "Ultrasensitive Chemical Analysis by Raman Spectroscopy", Chem. Rev. 1999, 99, 2957.
Koal, T.; Burhenne, H.; Romling, R.; Svoboda, M.; Resch, K.; Kaever, V.; Rapid Commun. Mass Spectrom., 2005, 19, 2995-3001.
Kogelschatz, Dielectric-barrier Discharges: Their History, Discharge Physics, and Industrial Applications, Plasma Chemistry and Plasma Processing, 23:1-46, 2003, published in Germany.
Koivunen, P., et al., Transformation by the (R)-enantiomer of 2-hydroxyglutarate linked to EGLN activation, Nature 483, 484-488 (2012), published in USA.
Kondrat and R. G. Cooks, Anal. Chem., 1978, 50, A81-A92.
Korecka, M.; Shaw, L. M. Ann. Transplant., 2009, 14, 61-72.
Krijnen et al., 2005, Clusterin: a protective mediator for ischemic cardiomyocytes? Am. J. Physiol. Heart. Circ. Physiol., 289:H2193-H2202.
Kujawinski et al., "Fate of Dispersants Associated with the Deepwater Horizon Oil Spill" Science and Technology, 2011, 45, 1298-1306.
Lai, A., et al., Evidence for sequenced molecular evolution of IDH1 mutant glioblastoma from a distinct cell of origin, J Clin Oncol 29, 4482-4490 (2011), published in USA.
Laiko et al., Atmospheric Pressure Matrix-Assisted Laser Desoprtion/Ionization Mass Spectrometry, Analytical Chemistry, 72:652-657, 2000, published in USA.
Laroussi et al., "Arc-Free Atmospheric Pressure Cold Plasma Jets: A Review", Plasma Process. Polym. 2007, 4, 777-788.
Lawson, G.; Tanna, S.; Mulla, H.; Pandya, H. J. Pharm. Pharmacol. 2009, 61, A33.
Lazovic, J., et al., Detection of 2-hydroxyglutaric acid in vivo by proton magnetic resonance spectroscopy in U87 glioma cells overexpressing isocitrate dehydrogenase-1 mutation, Neuro Oncol 14, 1465-1472 (2012), published in United Kingdom.
Lei,et al., "Increased Silver Activity for Direct Propylene Epoxidation via Subnanometer Size Effects", Science 2010, 328, 224-228.
Lejeune, D.; Souletie, I.; Houze, S.; Le Bricon, T.; Le Bras, J.; Gourmel, B.; Houze, P., J. Pharm. Biomed. Anal., 2007, 43, 1106-1115.
Li, et al. "Paper-Based Microfluidic Devices by Plasma Treatment," Anal. Chem. 2008, 80, pp. 9131-9134.
Li, et al. "Shell-isolated nanoparticle-enhanced Raman spectroscopy.", Nature 2010, 464, 392-395.
Li, et al., "Synthesis and Catalytic Reactions of Nanoparticles formed by Electrospray Ionization of Coinage Metals", Angew. Chem., Int. Ed. 2014, 53, 3147-3150.
Li, J. W.; Dewald, H. D.; Chen, H. Anal. Chem., 2009, 81, 9716-9722.
Li, P. K.; Lee, J. T.; Conboy, K. A.; Ellis, E. F.; Clin. Chem., 1986, 32, 552-555.
Li, W. K.; Zhang, J.; Tse, F. L. S., Biomed. Chromat., 2011, 25, 258-277.
Linehan, W.M. et al., The genetic basis of kidney cancer: a metabolic disease, Nat Rev Ural 7, 277-285 (2010), published in USA.
Liu et al. "Development, Characterization and Application of Paper Spray Ionization", Anal. Chem. 2010 (9 Pages).
Liu et al. "Transformation of Pd nanocubes into octahedra with controlled sizes by maneuvering the rates of etching and regrowth" J. Am. Chem. Soc. 2013, 135, 11752-11755.
Liu et al., "Biological Tissue Diagnostics Using Needle Biopsy and Spray Ionization Mass Spectrometry", Analytical Chemistry, 2011, 83, 9221-9225.
Liu et al., Measuring Protein?Ligand Interactions Using Liquid Sample Desorption Electrospray Ionization Mass Spectrometry, Anal. Chem. 2013, 85, 11966?11972.
Liu et al., Recent advances of electrochemical mass spectrometry, Analyst, 2013, 138, 5519-5539.
Liu et al., Signal and charge enhancement for protein analysis by liquid chromatography-mass spectrometry with desorption electrospray ionization, International Journal of Mass Spectrometry 325-327 (2012) 161-166.
Long and J. D. Winefordner, Anal. Chem., 1983, 55, A712-A724.
Losman, J.A., et al., (R)-2-Hydroxyglutarate Is Sufficient to Promote Leukemogenesis and Its Effects Are Reversible, Science 339:1621-1624 (2013), published in USA.
Lozano, et al. "Ionic Liquid Ion Sources: Characterization of Externally Wetted Emitters", Journal of Colloid and Interface Science, 2005, 282:415-421.
Lu, C., et al., IDH mutation impairs histone demethylation and results in a block to cell differentiation, Nature 483, 474-478 (2012), published in USA.
Lu, Drug Metab. Dispos., 1998, 26:1217-1222.
Lu, et al. "Mechanistic studies on the galvanic replacement reaction between multiply twinned particles of Ag and HAuCl4 in an organic medium" , J. Am. Chem. Soc. 2007, 129, 1733-1742.
Lu, X. M.; Rycenga, M.; Skrabalak, S. E.; Wiley, B.; Xia, Y. N.: Chemical Synthesis of Novel Plasmonic Nanoparticles. Annu. Rev. Phys. Chem. 60, 167-192.(2009).
Mandal, et al. "Solid probe assisted nanoelectrospray ionization mass spectrometry for biological tissue Diagnostics," Analyst, 2012, 137, pp. 4658-4661.
Manicke et al., J. Am. Soc. Mass. Spectrom., 2011, 22, 1501-1507.
Manicke NE, et al., 2009, Imaging of Lipids in Atheroma by Desorption Electrospray Ionization Mass Spectrometry, Analytical Chemistry 81(21):8702-8707, published in USA.
Manicke, N. E. et al., Int. J. Mass spectrom., 2011, 300, 123-129.
Mardis, E.R., et al., Recurring mutations found by sequencing an acute myeloid leukemia genome, N Engl J Med 361, 1058-1066 (2009), published in USA.
Marinetti, G. V.; In Lipid Chromatographic Analysis; Wuthier, R. E., Ed.; Marcel Dekker: New York, 1976; vol. 1, pp. 59-109.
Martinez et al., FLASH: A rapid method for prototyping paper-based microfluidic devices, Lab Chip 2008, 8, 2146-2150.
Martinez et al., Three-dimensional microfluidic devices fabricated in layered paper and tape, (Proc. Natl Acad. Sci. USA 2008, 105, 19606-19611), published in USA.

(56) References Cited

OTHER PUBLICATIONS

Martinez, et al. "Patterned Paper as a Platform for Inexpensive, Low-Volume, Portable Bioassays," Angew. Chem. Int. Ed. 2007, 46, pp. 1318-1320).
Miao et.al., Direct Analysis of Liquid Samples by Desorption Electrospray Ionization-Mass Spectrometry (DESI-MS), J Am Soc Mass Spectrom 2009, 20, 10-19.
Mirzaei et al., "Identification of oxidized proteins in rat plasma using avidin chromatography and tandem mass spectrometry", Proteomics, Wiley—VCH Verlag, Weinheim, DE, vol. 8, No. 7, Apr. 1, 2008 (Apr. 1, 2008), pp. 1516-1527, XP009169547, ISSN: 1615-9853.
Monge et al., Chemical Reviews, 2013, 113, 2269-2308.
Murty, M. Venkataramanan, T. Pradeep, "Self-assembled Monolayers of 1,4-Benzenedimethanethiol on Polyscrystalline Silver and Gold Films: An Investigation of Structure, Stability, Dynamics and Reactivity" Langmuir 1998, 14, 5446-5456.
Negri, R. J. Flaherty, O. O. Dada, Z. D. Schultz, "Ultrasensitive Online SERS Detection of Structural Isomers Separated by Capillary Zone Electrophoresis" Chem. Commun. 2014, 50, 2707-2710.
Nemes, P., Ambient mass spectrometry for in vivo local analysis and in situ molecular tissue imaging, TrAC-Trends in Analytical Chemistry 34, 22-33 (2012), published in United Kingdom.
Nge, M. Nogi, K. Suganuma, Journal of Materials Chemistry C 2013, 1, 5235-5243.
Ntale, M.; Mahindi, M.; Ogwal-Okeng, J. W.; Gustafsson, L. L.; Beck, O., J. Chromatogr. B: Anal. Technol. Biomed. Life Sci., 2007, 859, 137-140.
Oradu et al. "Multistep Mass Spectrometry Methodology for Direct Characterization of Polar Lipids in Green Microalgae Using Paperspray Ionization", Anal. Chem., 2012 (10 Pages).
Osberg, et al. "Dispersible Surface-Enhanced Raman Scattering Nanosheets", Adv. Mater. 2012, 24, 6065-70.
Otsuka, Y. et al., Scanning probe electrospray ionization for ambient mass spectrometry, Rapid Commun Mass Spectrom, (2012) 26(23):2725-32.
Parsons, D.W., et al., An integrated genomic analysis of human glioblastoma multiforme, Science 321, 1807-1812 (2008), published in USA.
Pope, W.B., et al., Non-invasive detection of 2-hydroxyglutarate and other metabolites in IDH1 mutant glioma patients using magnetic resonance spectroscopy, J Neurooncol 107, 197-205 (2012), published in Germany.
Rao, R. N.; Maurya, P. K.; Ramesh, M.; Srinivas, R.; Agwane, S. B., Biomed. Chromat., 2010, 24, 1356-1364.
Extended European Search Report, dated Aug. 20, 2018 for application No. 16747419/6, 11 pages.
Ren, 2016, Paper-capillary spray for direct mass spectrometry analysis of biofluid samples, Anal Bioanal Chem, 408:1385-1390.

PROBES, SYSTEMS, CARTRIDGES, AND METHODS OF USE THEREOF

RELATED APPLICATIONS

The present application claims the benefit of and priority to U.S. provisional application Ser. Nos. 62/112,799, filed Feb. 6, 2015, and 62/211,268, filed Aug. 28, 2015, the content of each of which is incorporated by reference herein in its entirety.

GOVERNMENT SUPPORT

This invention was made with government support under GM106016 awarded by the National Institutes of Health. The government has certain rights in the invention.

FIELD OF THE INVENTION

The invention generally relates to probes, systems, cartridges, and methods of use thereof.

BACKGROUND

Paper spray has been developed for direct mass spectrometry analysis of complex samples. It has been implemented for sample analysis on commercial lab-scale mass spectrometers as well as miniature mass spectrometers. Since its development, a set of unique advantages have been shown for paper spray through a variety of applications. For example, it is easy to implement paper spray. A triangle paper substrate with a sharp tip is used as the sample substrate and the liquid sample is deposited to form a dried sample spot, such as a dried blood spot (DBS). Direct sampling ionization is performed by wetting the substrate with a solvent and applying a high voltage of about 4000 V. The solvent elutes the analytes from the sample spot and a spray ionization is generated at the tip of the substrate to produce the analyte ions for mass spectrometry analysis. Paper spray is also suitable for design of disposable sample cartridges, which is important for implementing ambient ionization for clinical, especially point-of-care (POC) analysis using mass spectrometry. A commercial aftermarket paper spray source using disposable sample cartridge has been developed and used in clinical applications.

However, there are certain limitations to paper spray. Paper spray has not interfaced well with mass spectrometers that utilize a curtain gas (e.g., Sciex instruments). Paper spray has also had issues being interfaced with miniature mass spectrometers. Also, the sharp tip of a paper spray probe directly influences the performance of the probe and mass production processes for fabricating the paper substrates, such as die cutting, have inconsistency issues for making a sharp tip from the paper.

SUMMARY

The invention provides probes that interface well with mass spectrometers that employ a curtain gas and with miniature mass spectrometers. Aspects of the invention are accomplished by adding a hollow member (e.g., capillary emitter) to a porous substrate (e.g., paper substrate) for a paper-capillary spray. The data herein show that probes of the invention had significant, positive impact on the sensitivity and reproducibility for direct mass spectrometry analysis. The paper-capillary devices were fabricated and characterized for the effects due to the geometry, the treatment to the capillary emitters, as well as the sample disposition methods. Its analytical performance has also been characterized for sample analysis (such as analysis of therapeutic drugs in blood samples and quantitation of sitagliptin (JANUVIA)) in blood using a miniature ion trap mass spectrometer.

In certain aspects, the invention provides a probe that includes a porous material and a hollow member coupled to a distal portion of the porous material. In certain embodiments, the hollow member extends beyond a distal end of the porous material. Numerous different types of hollow members can be used with probes of the invention. An exemplary hollow member is a capillary tube. Similarly, numerous types of porous materials can be used with probes of the invention. An exemplary porous material is paper, such as filter paper. In certain embodiments, the porous material includes a cut within a distal portion of the material and the hollow member fits within the cut. In certain embodiments, a distal end of the hollow member is smoothed.

Another aspect of the invention provides a cartridge including a housing with an open distal end, and a probe situated within the housing. The probe includes a porous material and a hollow member coupled to a distal portion of the porous material and operably aligned to the open distal end of the housing. The housing may have numerous additional features. For example, the housing may include an opening to a porous material of the probe such that a sample can be introduced to the probe. The housing may also include a coupling for an electrode, such that an electric filed can be applied to the probe. In certain embodiments, the housing includes a plurality of prongs that extend from the open distal end of the housing. In certain embodiments, the housing includes a solvent reservoir.

Another aspect of the invention provides a system that includes a probe including a porous material and a hollow member coupled to a distal portion of the porous material, an electrode coupled to the porous material, and a mass spectrometer. Any type of mass spectrometer can be used with systems of the invention. For example, the mass spectrometer may be a bench top mass spectrometer or a miniature mass spectrometer. The mass spectrometer may include a curtain gas.

Another aspect of the invention provides methods for analyzing a sample. The methods may involve providing a probe including a porous material and a hollow member coupled to a distal portion of the porous material, contacting a sample to the porous material, generating ions of the sample from the probe that are expelled from a distal end of the hollow member, and analyzing the ions. The generating step may include applying a solvent and an electric field to the probe. In certain embodiments, a solvent does not need to be used and an electric field alone applied to the probe is sufficient to generate the ions of the sample. In certain embodiments, analyzing includes introducing the ions into a mass spectrometer, such as a bench top mass spectrometer or a miniature mass spectrometer. The methods of the invention can be used to analyze any sample, such as a biological sample.

BRIEF DESCRIPTION OF THE DRAWINGS

FIG. 6 panel B shows a side view of inserting the capillary into a split paper substrate. FIG. 6 panel C shows the capillary embedded into a cut made half-way through the paper substrate.

FIG. 7 panel B is a photograph of a burnt capillary. FIG. 7 panels C-D show the analysis of dried blood spots each prepared by depositing 3 μL bovine whole blood containing 100 ng/mL methamphetamine on the paper substrate. FIG. 7 panel C shows the extracted ion chronograms for MS/MS transition m/z 150→91. FIG. 7 panel D shows MS/MS spectra, recorded with the original and burnt capillaries.

FIG. 8 panel B shows an ion chronogram recorded using a 3 mm capillary on paper substrate, SRM analysis m/z 278→233 for amitriptyline 100 ng/mL in bovine whole blood. Each DBS prepared with 3 μL blood sample.

FIG. 9 panels D-F show MS/MS analysis of imatinib using QTrap 4000. FIG. 9 panels G-I show MS/MS analysis of amitriptyline using Mini 12. For FIG. 9 panels D and G, Grade 1 paper spray is the substrate. For FIG. 9 panels E and H, ET31 paper spray is the substrate. For FIG. 9 panels F and I, paper-capillery device (3 mm emitter) is used. Imatinib in MeOH: $H_2O$ (9:1, v:v) at 50 ng/mL and amitriptyline in MeOH: $H_2O$ (9:1, v:v) at 20 ng/mL.

FIG. 10 panel A shows a sample center spotted and FIG. 10 panel B shows a sample with edge-to-edge deposition. 3 μL blood sample was used to prepare a DBS. FIG. 10 panel C shows a calibration curve of sitagliptin in bovine whole blood, established using Mini 12 and paper-capillary spray, MS/MS with m/z 408 as precursor ion, intensity of fragment ion m/z 235 used. The inset shows the linearity for the range 10-500 ng/mL.

FIG. 11 panel B shows the change of the design for sample cartridge, from using paper spray to paper-capillary spray. FIG. 11 panel C shows analysis of Januvia (Sitagliptin) in blood using the paper-capillary spray and mini 12. FIG. 11 panels D-F show proposed methods for incorporating IS for quantitation at simple operation.

DETAILED DESCRIPTION

Figure 1:
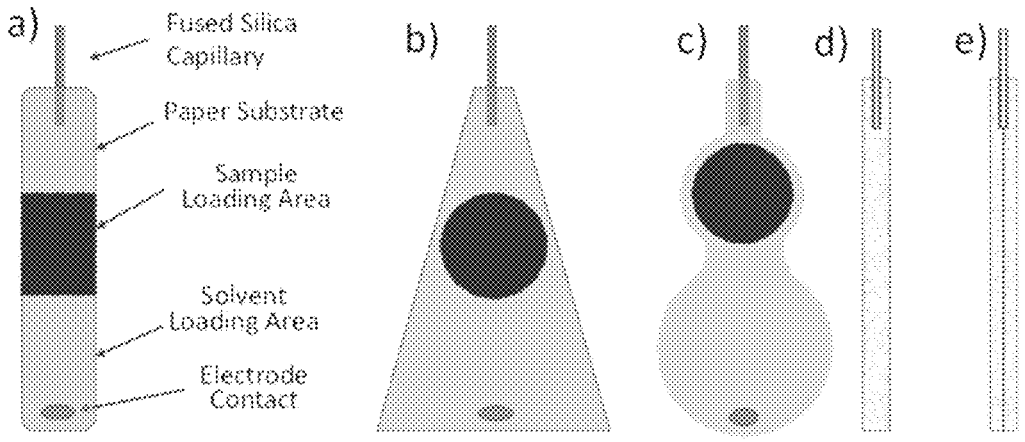
FIG. 1 panels A-E are exemplary designs of a system.
Figure 2:
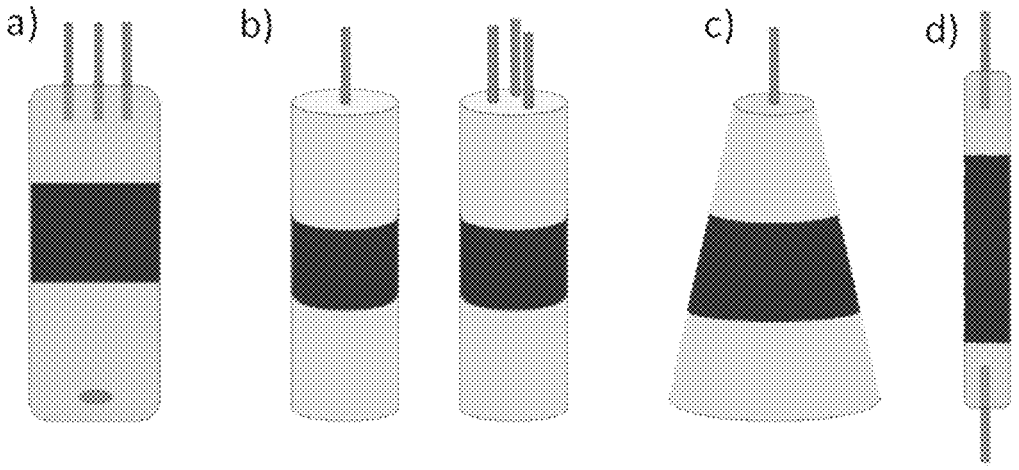
FIG. 2 panels A-D are exemplary designs of a system with more than one spray emitter and/or a system with a three-dimensional sample substrate.

The invention generally relates to probes, cartridges, systems and methods for analysis of samples loaded onto a porous material with the spray ionization from a spray emitter having a hollow body (member) and a distal tip. One example of a spray emitter with a hollow body is a capillary. An exemplary design is shown in FIGS. 1-2. A porous material, such as paper, can be used as the sample substrate. A hollow capillary, such as a fused silica capillary (i.d. 49 μm, i.d. 150 μm), can be coupled with (e.g. inserted into) the sample substrate. An extraction solvent can be applied onto the sample substrate and a high voltage can be applied to the wetted substrate. The solvent can wick through the sample substrate toward the capillary, extract the analytes in the deposited sample, and carry them into the capillary. The spray ionization can occur at the distal tip of the spray emitter and ions are produced. The ions may be produced for mass analysis. Spray emitters of different internal and external diameters can be used to optimize the spray ionization. The spray emitter may be made of glass, quartz, Teflon, metal, silica, plastic, or any other non-conducting or conducting material.

The sample substrate may be any shape as illustrated in FIG. 1 panels A-E and FIG. 2 panels A-D. Generally, sharp corners are removed from the sample substrate to reduce inducing a spray from the sample substrate, however, the sample substrate may have corners. The sample substrate comprises a porous material. Any porous material, such as polydimethylsiloxane (PDMS) membranes, filter paper, cellulose based products, cotton, gels, plant tissue (e.g., a leaf or a seed) etc., may be used as the substrate.

Exemplary substrates are described, for example in Ouyang et al. (U.S. Pat. No. 8,859,956), the content of each of which is incorporated by reference herein in its entirety. In certain embodiments, the porous material is any cellulose-based material. In other embodiments, the porous material is a non-metallic porous material, such as cotton, linen, wool, synthetic textiles, or glass microfiber filter paper made from glass microfiber. In certain embodiments, the substrate is plant tissue, such as a leaf, skin or bark of a plant, fruit or vegetable, pulp of a plant, fruit or vegetable, or a seed. In still other embodiments, the porous material is paper. Advantages of paper include: cost (paper is inexpensive); it is fully commercialized and its physical and chemical properties can be adjusted; it can filter particulates (cells and dusts) from liquid samples; it is easily shaped (e.g., easy to cut, tear, or fold); liquids flow in it under capillary action (e.g., without external pumping and/or a power supply); and it is disposable. in certain embodiments, the probe is kept discrete (i.e., separate or disconnected from) from a flow of solvent. Instead, a sample is either spotted onto the porous material or the porous material is wetted and used to swab a surface containing the sample.

In particular embodiments, the porous material is filter paper. Exemplary filter papers include cellulose filter paper, ashless filter paper, nitrocellulose paper, glass microfiber filter paper, and polyethylene paper. Filter paper having any pore size may be used. Exemplary pore sizes include Grade 1 (I ΐμιη), Grade 2 (8 μιη), Grade 595 (4-7 μιη), and Grade 6 (3 μιη), Pore size will not only influence the transport of liquid inside the spray materials, but could also affect the formation of the Taylor cone at the tip. The optimum pore size will generate a stable Taylor cone and reduce liquid evaporation. The pore size of the filter paper is also an important parameter in filtration, i.e., the paper acts as an online pretreatment device. Commercially available ultrafiltration membranes of regenerated cellulose, with pore sizes in the low nm range, are designed to retain particles as small as 1000 Da. Ultra filtration membranes can be commercially obtained with molecular weight cutoffs ranging from 1000 Da to 100,000 Da.

In other embodiments, the porous material is treated to produce microchannels in the porous material or to enhance the properties of the material for use in a probe of the invention. For example, paper may undergo a patterned silanization process to produce microchannels or structures on the paper. Such processes involve, for example, exposing the surface of the paper to tridecafluoro-1,1,2,2-tetrahydrooctyl-1-trichlorosilane to result in silanization of the paper. In other embodiments, a soft lithography process is used to produce microchannels in the porous material or to enhance the properties of the material for use as a probe of the invention. In other embodiments, hydrophobic trapping regions are created in the paper to pre-concentrate less hydrophilic compounds.

Hydrophobic regions may be patterned onto paper by using photolithography, printing methods or plasma treatment to define hydrophilic channels with lateral features of 200-1000 μιη. See Martinez et al. (Angew. Chem. Int. Ed. 2007, 46, 1318-1320); Martinez et al. (Proc. Natl Acad. Sci. USA 2008, 105, 19606-19611); Abe et al. (Anal. Chem. 2008, 80, 6928-6934); Bruzewicz et al. (Anal. Chem. 2008, 80, 3387-3392); Martinez et al. (Lab Chip 2008, 8, 2146-2150); and Li et al. (Anal. Chem. 2008, 80, 9131-9134), the content of each of which is incorporated by reference herein in its entirety. Liquid samples loaded onto such a paper-based device can travel along the hydrophilic channels driven by capillary action.

Another application of the modified surface is to separate or concentrate compounds according to their different affinities with the surface and with the solution. Some compounds are preferably absorbed on the surface while other chemicals in the matrix prefer to stay within the aqueous phase. Through washing, sample matrix can be removed while compounds of interest remain on the surface. The compounds of interest can be removed from the surface at a later point in time by other high-affinity solvents. Repeating the process helps desalt and also concentrate the original sample.

In certain embodiments, chemicals are applied to the porous material to modify the chemical properties of the porous material. For example, chemicals can be applied that allow differential retention of sample components with different chemical properties. Additionally, chemicals can be applied that minimize salt and matrix effects. In other embodiments, acidic or basic compounds are added to the porous material to adjust the pH of the sample upon spotting. Adjusting the pH may be particularly useful for improved analysis of biological fluids, such as blood. Additionally, chemicals can be applied that allow for on-line chemical derivatization of selected analytes, for example to convert a non-polar compound to a salt for efficient electrospray ionization.

In certain embodiments, the chemical applied to modify the porous material is an internal standard. The internal standard can be incorporated into the material and released at known rates during solvent flow in order to provide an internal standard for quantitative analysis. In other embodiments, the porous material is modified with a chemical that allows for pre-separation and pre-concentration of analytes of interest prior to mass spectrum analysis.

In certain embodiments, the porous material is kept discrete (i.e., separate or disconnected) from a flow of solvent, such as a continuous flow of solvent. Instead, sample is either spotted onto the porous material or swabbed onto it from a surface including the sample. A discrete amount of extraction solvent is introduced into the port of the probe housing to interact with the sample on the substrate and extract one or more analytes from the substrate. A voltage source is operably coupled to the probe housing to apply voltage to the solvent including the extract analytes to produce ions of the analytes that are subsequently mass analyzed. The sample is extracted from the porous material/substrate without the need of a separate solvent flow.

A solvent is applied to the porous material to assist in separation/extraction and ionization. Any solvents may be used that are compatible with mass spectrometry analysis. In particular embodiments, favorable solvents will be those that are also used for electrospray ionization.

Exemplary solvents include combinations of water, methanol, acetonitrile, and tetrahydrofuran (THF). The organic content (proportion of methanol, acetonitrile, etc. to water), the pH, and volatile salt (e.g. ammonium acetate) may be varied depending on the sample to be analyzed. For example, basic molecules like the drug imatinib are extracted and ionized more efficiently at a lower pH. Molecules without an ionizable group but with a number of carbonyl groups, like sirolimus, ionize better with an ammonium salt in the solvent due to adduct formation.

Figure 3:
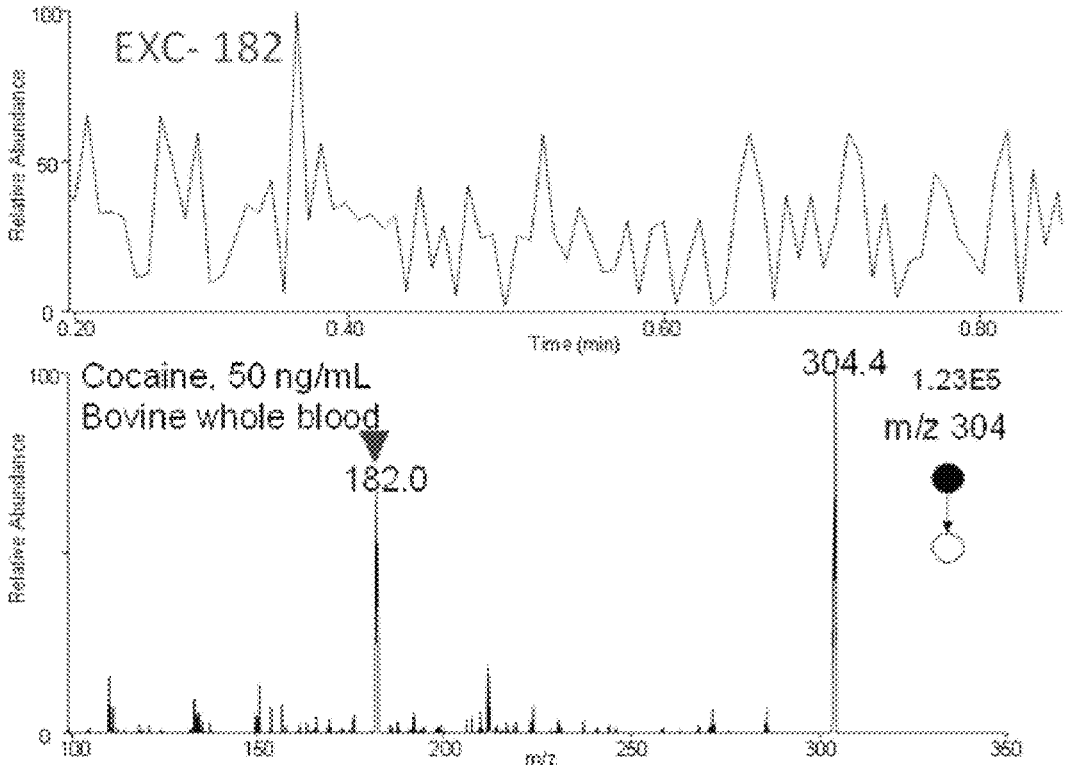
FIG. 3 is a graph showing an analysis of cocaine in bovine blood using a device as that shown in FIG. 1 panel B and a commercial TSQ mass spectrometer.
Figure 4:
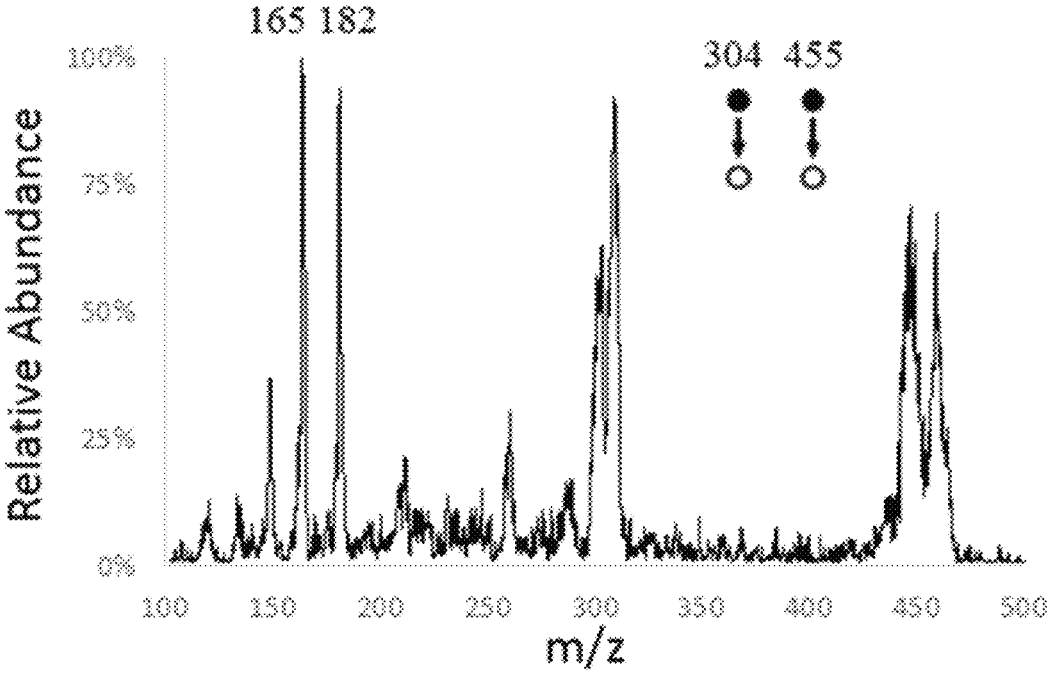
FIG. 4 is a graph showing an analysis of cocaine and verapamil in methanol using a device as that shown in FIG. 1 panel A and a desktop Mini 12 mass spectrometer.
Figure 5:
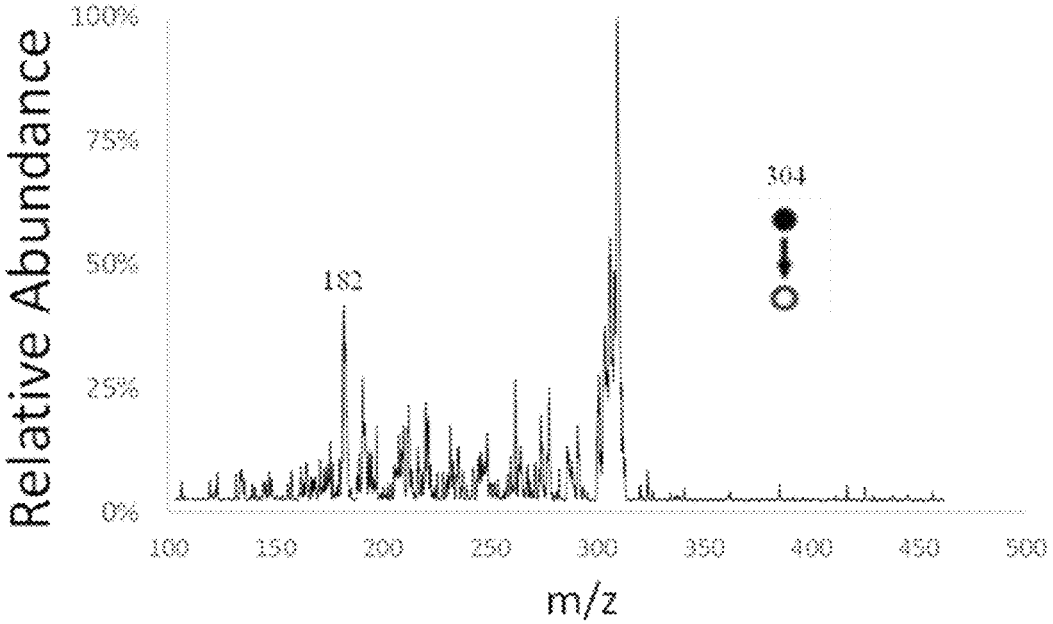
FIG. 5 is a graph showing an analysis of cocaine in bovine blood using as device as that shown in FIG. 1 panel B and a desktop Mini 12 mass spectrometer.

FIG. 1 panels B-C show two alternative designs of the sample substrate. FIG. 1 panels D-E show the section views of two exemplary designs. The capillary can be inserted into a sample substrate or between two layers of sample substrates. FIG. 2 panel A shows a configuration with multiple capillary sprayers included with a single sample substrate of a planar shape. FIG. 2 panel B shows a configuration with a cylindrical substrate. FIG. 2 panel C shows a configuration with a cone-shape substrate. FIG. 2 panel D shows an example of a sample substrate connected with multiple spray emitters. FIG. 3 shows the analysis of cocaine in bovine blood using a device as that shown in FIG. 1 panel B and a commercial TSQ mass spectrometer. FIG. 4 shows the analysis of cocaine and verapamil in methanol using a device as that shown in FIG. 1 panel A and a desktop Mini 12 mass spectrometer. FIG. 5 shows the analysis of cocaine in bovine blood using as device as that shown in FIG. 1 panel B and a desktop Mini 12 mass spectrometer.

In further embodiments the device may comprise a sprayer integrated with a sample substrate for direct sampling ionization. The sample substrate can be porous. The sprayer can be a hollow capillary or a solid tip. In other aspects a fluid sample can also be taken directly from the distal end of the capillary by capillary effect. The substrate can be wetted to serve as a conductor for the high voltage required for generating the spray ionization. In other aspects a coating of the capillary can be removed to allow light to pass through and thereby photochemical reactions to be carried on in the solution inside the capillary. In other aspects multiple spray emitters can be coupled to the sample substrate. The multiple spray emitters may be on the same side of the sample substrate or may be coupled on different sides of the sample substrate, with some acting as sprayers while others operate as a channel for transferring sample, solvent and reagents to the substrate. In other aspects a sample substrate can be covered or sealed to prevent the evaporation of the extraction solvent.

Sample Cartridges and Kits

Figure 11:
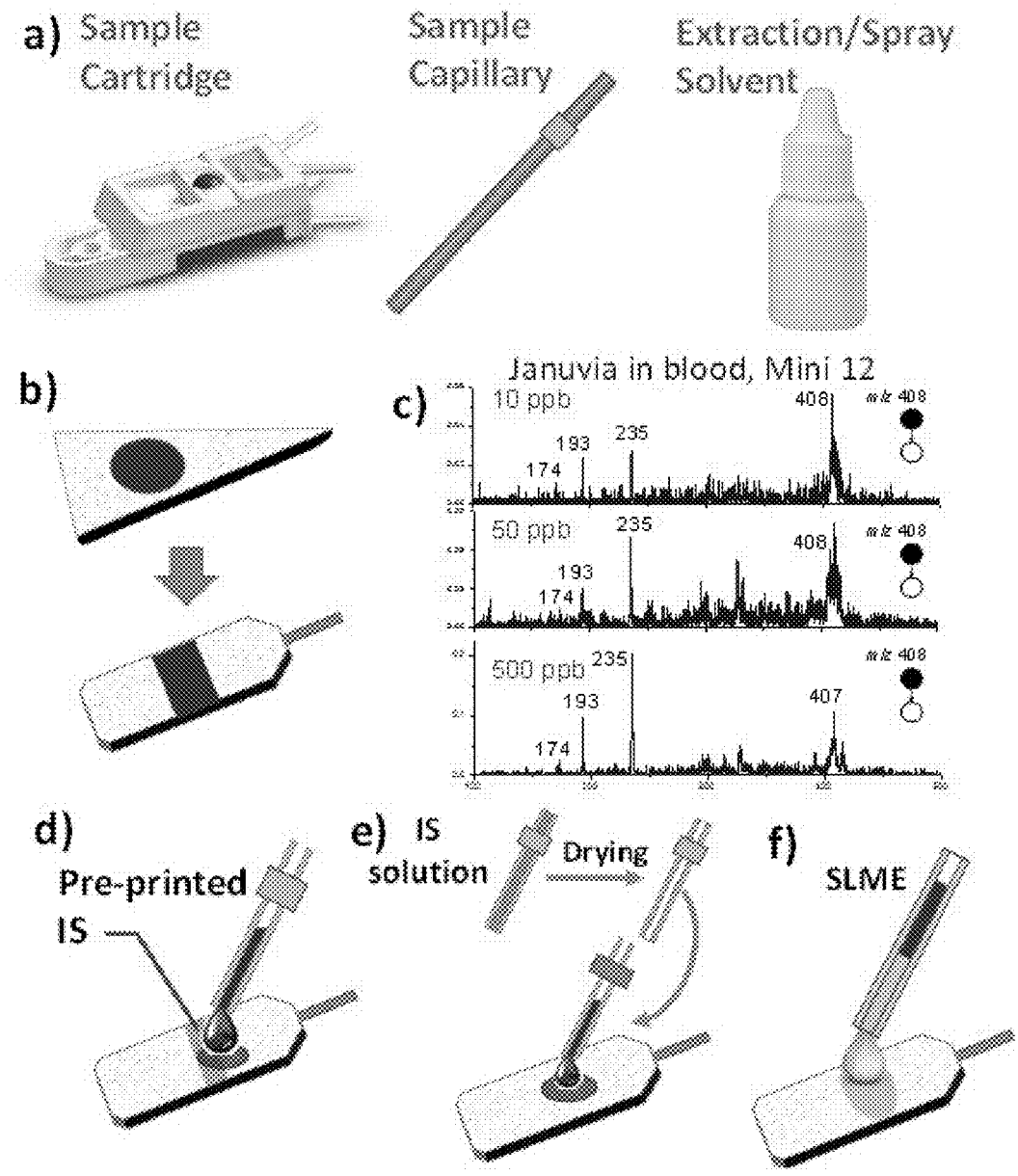
FIG. 11 panel A shows an exemplary disposable analysis kit for POC MS system.

The revolution to the MS application by the proposed POC MS system relies on the ease of use of the system by personnel un-trained with chemical analysis, such as nurses and physicians. Although the miniature ion trap mass spectrometer to be developed is versatile and applicable for a wide range of applications, special sampling kits, along with special user interface for operation, are important to make the operation simple for the end users. FIG. 11 panel A shows an exemplary sample cartridge. The cartridge includes a housing with an open distal end. The probes of the invention are situated with within the housing. The probe includes a porous material and a hollow member coupled to a distal portion of the porous material and operably aligned to the open distal end of the housing. The housing may have numerous additional features. For example, the housing may include an opening to a porous material of the probe such that a sample can be introduced to the probe. The housing may also include a coupling for an electrode, such that an electric filed can be applied to the probe. In certain embodiments, the housing includes a plurality of prongs that extend from the open distal end of the housing. In certain embodiments, the housing includes a solvent reservoir. Example details about the housing are described for example in PCT/US12/40513, the content of which is incorporated by reference herein in its entirety.

The components in an exemplary sampling kit are shown in FIG. 11 panel A. It has a sample cartridge, a sampling capillary and a small bottle of solvent. The sampling capillary can be used, through capillary effect, to take a biofluid sample at amount well controlled by the volume of the capillary. This type of capillary is available at medical level for a variety of volumes, such as 5, 10, 15 μL (Drummond Scientific Company, Broomall, Pa.) This is particularly suitable for taking blood samples with finger prick. The sample can then be deposited onto the sample cartridge, to be immediately analyzed or let dry to form a dried sample spot for later analysis.

The extraction/spray solvent can be provided in a small bottle, similar to those used for eye drops. Small amounts of solvent can be relatively consistently deposited by simply squeezing the bottle by hand. In previous test of paper spray, adverse impact on the sensitivity or quantitation prevision due to the variation in solvent amount was not observed, as long as the internal standards are not incorporated through the extraction/spray solvent. Use of the bottled solvent for supply with the cartridge and capillary improves the flexibility of making special kits for manufacturing purpose. Solvents used for different applications, such as methanol, acetyl nitrile, ethyl acetate, and their combination with other solvents and reagents, can be produced with the optimized formula and provided for the best performance for the target analysis. The sample cartridge and the sampling capillary can be packed in the same package while the bottled solvent can be provided separately, which can be used with multiple cartridge/capillary packages. Alternatively, a small solvent kit for one-time use can be provided, which can be included in the same package with the cartridge and capillary.

For the sample cartridge, a paper substrate with an inserted fused capillary is used (FIG. 11 panel B). In a previous test, it was found that the sharpness of the tip for a paper spray probe and the thickness of the paper substrate have a significant impact on the desolvation of the spray process, which is less a problem for use with commercial mass spectrometer but an issue for a miniature system with a less suffocated atmospheric pressure interface. The thin paper, such as Whatman Grade 1 of 0.18 mm thickness, was found to provide a sensitivity at least 5 time higher for Mini 12 in comparison with Whatman ET31 of 0.5 mm thickness. However, the thin paper mechanically becomes soft when is wetted and is not suitable for assembly of a cartridge. It has also been recognized that fabrication of a sharp tip of a paper substrate remains challenging for industrial mass production process. Using a pulled sharp glass tip as in extraction spray, ionization of an efficiency for nanoESI is guaranteed, but the analysis protocol for extraction spray is not as user-friendly as paper spray.

The probes of the invention combine a glass spray tip with a paper substrate for ambient ionization. The coating of a fused silica capillary, 150/50 μm o.d./i.d. and 10 mm long, was stripped off by burning. The capillary was then inserted into an ET31 substrate serving as a spray tip. This design takes the advantages of the sample cleaning up process in paper spray and improved ionization efficiency with a sharp spray tip in extraction spray. The data below show that a sensitivity equal to the Grad 1 substrate was obtained. In the analysis of sitagliptin (JANUVIA, collaboration with Merck & Co. Inc.) in blood samples using Mini 12, an LOD or 3 ng/mL and LOQ of 10 ng/mL was obtained.

Miniature Mass Spectrometers

In certain embodiments, the mass spectrometer is a miniature mass spectrometer. An exemplary miniature mass spectrometer is described, for example in Gao et al. (Z. Anal. Chem. 2006, 78, 5994-6002), the content of which is incorporated by reference herein in its entirety In comparison with the pumping system used for lab-scale instruments with thousands watts of power, miniature mass spectrometers generally have smaller pumping systems, such as a 18 W pumping system with only a 5 L/min (0.3 m3/hr) diaphragm pump and a 11 L/s turbo pump for the system described in Gao et al. Other exemplary miniature mass spectrometers are described for example in Gao et al. (Anal. Chem., 80:7198-7205, 2008), Hou et al. (Anal. Chem., 83:1857-1861, 2011), and Sokol et al. (Int. J. Mass Spectrom., 2011, 306, 187-195), the content of each of which is incorporated herein by reference in its entirety. Miniature mass spectrometers are also described, for example in Xu et al. (JALA, 2010, 15, 433-439); Ouyang et al. (Anal. Chem., 2009, 81, 2421-2425); Ouyang et al. (Ann. Rev. Anal. Chem., 2009, 2, 187-214); Sanders et al. (Euro. J. Mass Spectrom., 2009, 16, 11-20); Gao et al. (Anal. Chem., 2006, 78(17), 5994 -6002); Mulligan et al. (Chem. Com., 2006, 1709-1711); and Fico et al. (Anal. Chem., 2007, 79, 8076-8082). ), the content of each of which is incorporated herein by reference in its entirety.

Discontinuous Atmospheric Pressure Interface

In certain embodiments, systems of the invention are equipped with a discontinuous interface, which is particularly useful with miniature mass spectrometers. An exemplary discontinuous interface is described for example in Ouyang et al. (U.S. Pat. No. 8,304,718), the content of which is incorporated by reference herein in its entirety.

Quantitation

A main objective of the product development is to enable simple analysis using the MS technology while retaining the mandatory qualitative and quantitative performance. Based on the previous experience in the development of ambient ionization and miniature MS systems, it is believed that the incorporation of internal standards is of a long-term benefit for production development. MRM (multi-reaction monitoring) measurement of A/IS ratio has been proved to be a robust and effective method for obtaining high quantitation precision for both lab-scale[39] and miniature MS systems. For the POC MS product development, however, the lab techniques and procedures for incorporating the IS need to be completely replaced by simple methods suitable for POC procedures.

In one embodiment, pre-printing internal standard (IS) on paper substrates can be done when manufacturing the cartridges, so the IS can be mixed into the biofluid sample when it was deposited. The sample volume is controlled by the capillary volume. In previous studies, RSD better than 13% has been obtained; however, it was also found that inconsistency in deposition of IS and biofluid sample could have a significant adverse impact on the quantitation results. Inkjet printing can be used to despite the known amount of IS compounds within a narrow band on the paper substrate, which can be completely covered by the biofluid sample to be deposited. This is expected to significantly improve the reproducibility.

IS-coated sampling capillary is another approach for performing quantitation with a simple procedure. The IS coating inside the capillary wall is prepared by filling the capillary with the IS solution through capillary effect and then letting the solution dry. The IS is mixed into the sample filled also by the capillary effect. A very significant advantage of this method is that accurate control of the capillary volume is not required for obtaining high consistency for quantitation, since the amounts of the IS solution and biofluid sample involved are always the same. This represents a huge simplification for mass production. The data show RSDs better than 5% were obtained for blood and urine samples of amounts as small as 1 μL. The IS coated capillaries can be packed in plastic bags, filled with air or dried nitrogen, and stored in both room and reduced temperatures for 1 to 20 weeks.

In addition to the two methods above, another method for performing a direct analyte extraction involves using slug flow microextraction (PCT/US15/13649, the content of which is incorporated by reference herein in its entirety) followed by the spray ionization using the cartridge (FIG. 11 panel F). This method has two potential advantages. The immediate extraction of the analytes helps to preserve the analytes that are unstable due to the reactions in wet biofluids, such as hydralazine in blood. Also, incorporation of IS can be performed with the extraction. In a previous study, methamphetamine-d8 was pre-spiked into the extraction solvent, ethyl acetate, for quantitation of the methamphetamine urine. Both the IS and the analyte were redistributed between the two phases based on an identical partitioning coefficient; therefore, their ratios measured for the extraction solvent can be used for quantify the original concentration of the methamphetamine in the urine sample.

Incorporation by Reference

References and citations to other documents, such as patents, patent applications, patent publications, journals, books, papers, web contents, have been made throughout this disclosure. All such documents are hereby incorporated herein by reference in their entirety for all purposes.

Equivalents

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

EXAMPLES

During the application of paper spray on different commercial mass spectrometers and the home built miniature mass spectrometers, it has been observed that a series factors can significantly affect the performance of paper spray MS analysis. An overall best performance was observed with mass spectrometers using heated capillary, such as the TSQ (Thermo Scientific, San Jose, Calif., USA). For QTrap 4000 (Sciex, Concord, Ontario, Canada) with a curtain gas, the spray was found to be less stable and of short duration due to the curtain gas drying the solvent on paper. The Whatman ET 31 paper (Whatman International Ltd, Maidstone, ENG) of 0.5 mm thickness was used for the substrates in the commercial paper spray cartridges. However, when applying paper spray with Mini 12 mass spectrometer, the Whatman Grade 1 paper of 0.18 mm thickness was found to provide a sensitivity much better than ET 31. The thickness of the substrate affect the sharpness of the spray tip and therefore larger droplets are formed with thicker substrates during the spray. With the less sophisticated interface on Mini 12, a discontinuous atmospheric pressure interface (DAPI) without heated capillary or curtain gas, the desolvation is less efficient and the sensitivity decreases significantly for the MS analysis using ET 31 as substrates for paper spray. Unfortunately, the thin paper substrates, such as Grade 1, becomes very soft when wetted and therefore cannot be used in the cartridge. We also found that mass production processes for fabricating the paper substrates, such as the die cutting, have inconsistency issues for making a sharp tip from the paper.

In a previous study, we have used the extraction spray to achieve an improved sensitivity and quantitation precision for using Mini 12 to analyze therapeutic drugs in blood samples. A paper strip with dried blood spot was inserted into a nanoESI tube with a pulled tip for spray, where the analytes were extracted into the solvent in the tube and spray ionized through the pulled tip. The extraction spray is an example which takes advantage of the fast sample cleaning up followed by spray ionization with a well-shaped tip. The implementation of the extraction spray itself for cartridge design, however, represents a complication for the analysis protocol. With an intention to solve the observed issues for paper spray and to develop a disposable cartridge with satisfactory performance for miniature MS system, we developed a paper-capillary device (FIG. 6 panel A) to replace the paper substrate for direct sampling ionization. A systematic characterization has been carried out for the simple device in comparison with the original paper spray.

Example 1

Methods

All chemicals were purchased from Sigma-Aldrich (St. Louis, Mo., USA). Bovine whole blood was purchased from Innovative Research (Novi, Mich., USA). Chromatography papers (grade 1 and ET31) used for making paper substrate were purchased from Whatman (Whatman International Ltd, Maidstone, ENG). Fused silica tubing (O.D. 130 μm, I.D. 50 μm) for paper capillary spray was purchased from Molex Inc. (Lisle, Ill., USA). MS analysis were performed using a QTrap 4000 mass spectrometer (Applied Biosystems, Toronto, CA) equipped with an atmospheric pressure interface (API) using curtain gas and a home-made miniature mass spectrometer, Mini 12 with a discontinuous atmospheric interface.

For paper spray, spray substrates were prepared by cutting the paper into triangles of 6 mm at the base and 10 mm at the height. An alligator clipper was used to hold the paper substrate during the paper spray with a dc voltage of 3.5 kV applied to the clipper. If not specified, elution solvents of 25 μL and 70 μL were used for paper spray with Grade 1 (0.18 mm thick) and ET31 (0.5 mm thick) substrates, respectively. For fabricating the paper-capillary devices, a fused silica tubing of 50 μm i.d. and 150 μm o.d. was cut into short pieces using a ceramic cutter. The capillary was then inserted into the ET31 (0.5 mm thick) paper substrate with a length of about 3 mm embedded in the paper.

Example 2

Sample Analysis Using Probes of the Invention

Figure 6:
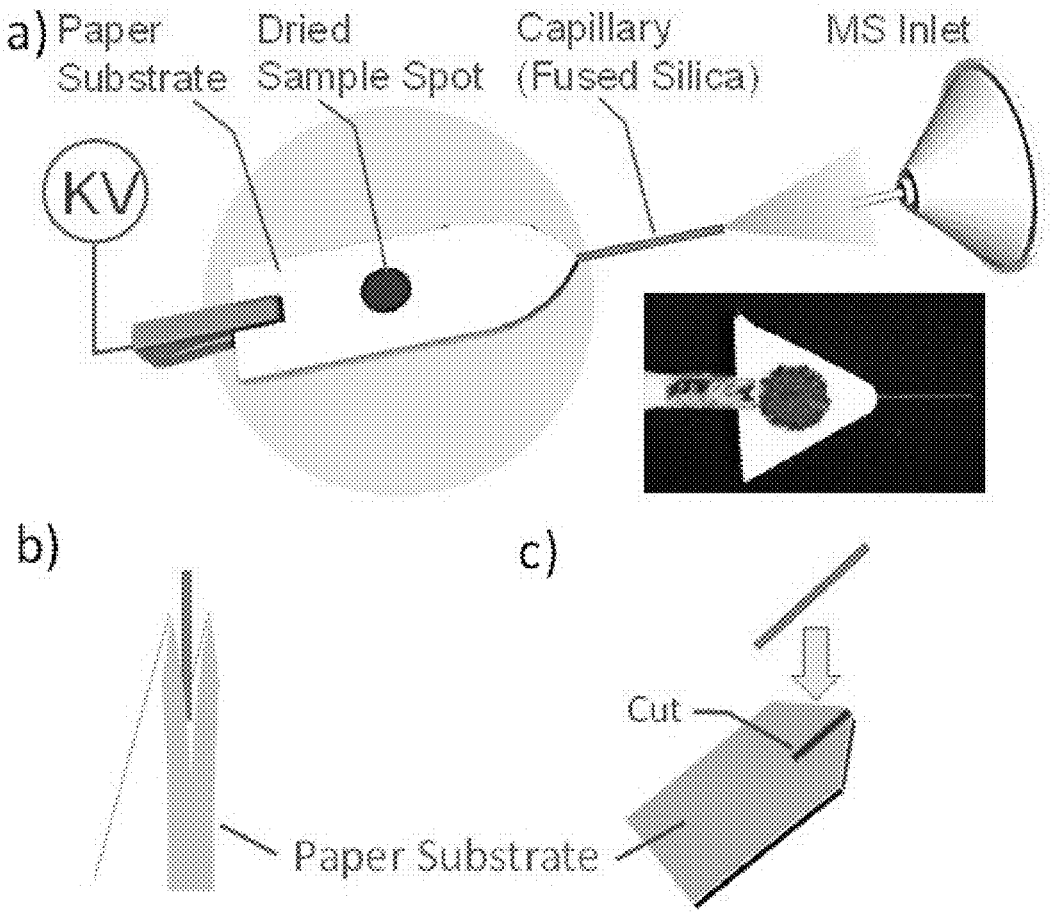
FIG. 6 panel A shows a schematic of using paper-capillary spray for analysis of dried blood spot. The inset shows a picture of paper-capillary substrate. Methods of fabricating the paper-capillary substrate.

FIG. 6 panel A shows a system of the invention. The system includes a probe including a porous material and a hollow member (e.g., hollow capillary). The probe is coupled to an electrode via the porous material and the probe generates ions that are expelled from the hollowing member to a mass spectrometer, such as a miniature mass spectrometer. The paper-capillary devices of the invention could be fabricated in two different ways. A paper substrate could be split from the side using a razor blade for the capillary to be inserted in (FIG. 6 panel B); or a cut can be made halfway through on the ET31 paper substrate and then the capillary can be pushed and embedded into the cut (FIG. 6 panel C). No significant difference in performance was observed between the devices made by these two methods. However, the latter method might be more suitable for mass production of the devices.

Figure 7:
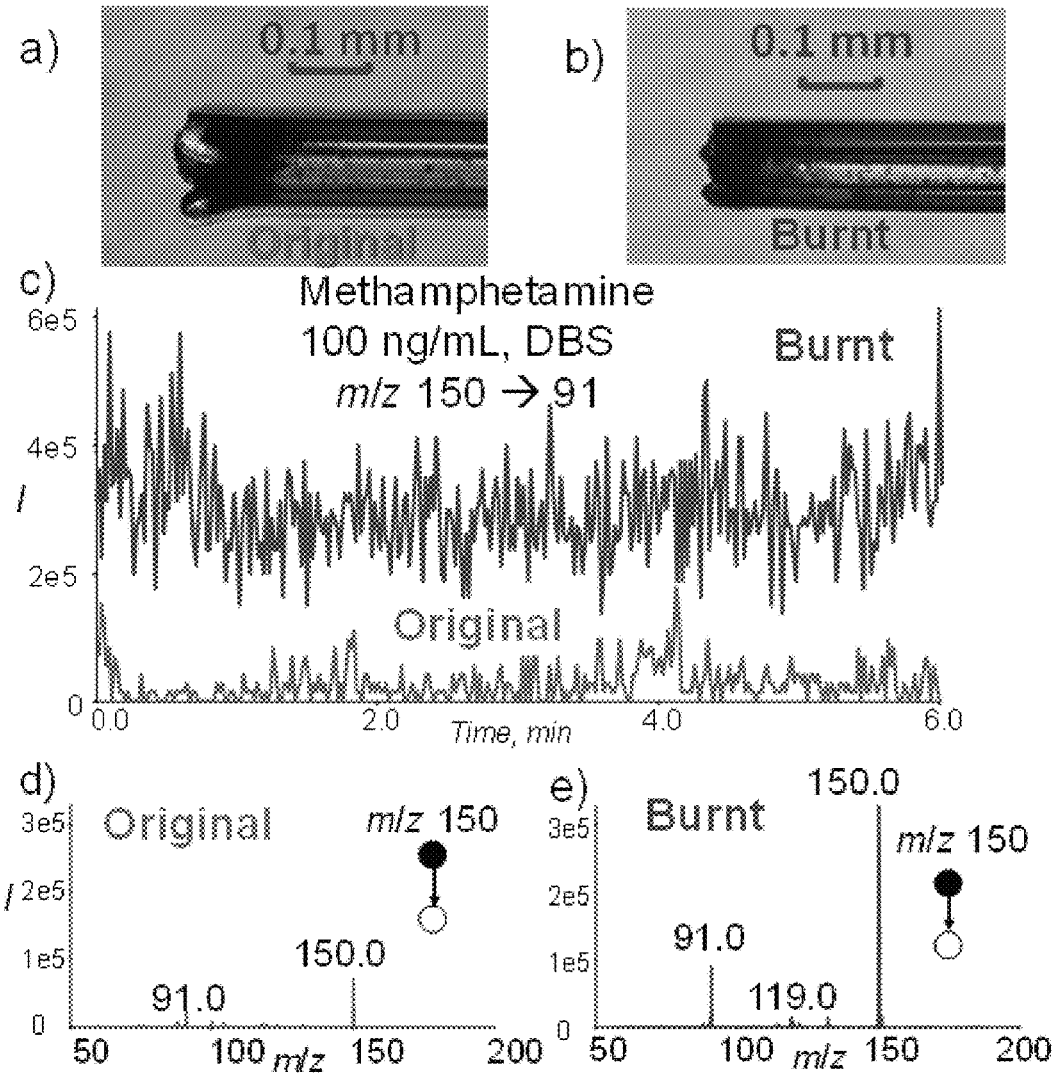
FIG. 7 panel A is a photograph of an original capillary.

The end of the capillary after the cut was expected to have an irregular shape with sharp micro tips, as shown with the photo (FIG. 7 panel A) taken with a microscope. These micro tips could cause split sprays. A cigarette lighter was used to burn the capillaries to remove the polyamide coatings as well as to smooth the edge at the ends of each capillary (FIG. 7 panel B). Paper-capillary devices were made using both the original and burnt capillaries, with an emitter extended out for 3 mm. They were used for analysis of bovine whole blood samples containing methamphetamine at a concentration of 100 ng/mL. For each analysis, 3 μL blood sample was deposited onto the paper substrate and let dry to form a DBS. MeOH:$H_2O$ (9:1, v:v) of 70 μL was then applied as the extraction/spray solvent. A QTrap 4000 was used to perform the MS/MS analysis with $[M+H]^+$ m/z 150 as the precursor ions. The ion chronograms for the characteristic fragment ion m/z 91 were extracted as shown in FIG. 7 panel C. The averaged MS/MS spectra are also shown in FIG. 7 panels D-E for comparison. A three-time higher signal intensity was obtained for use of a burnt capillary emitter. The rough edges with the original capillary could cause split sprays, which makes the spray current unstable and of lower intensity. With the polyimide coating removed, the outer diameter of the capillary was decreased by about 20 μm, which also helps to produce smaller droplets during the spray and ultimately helps to improve the ion signals.

Figure 8:
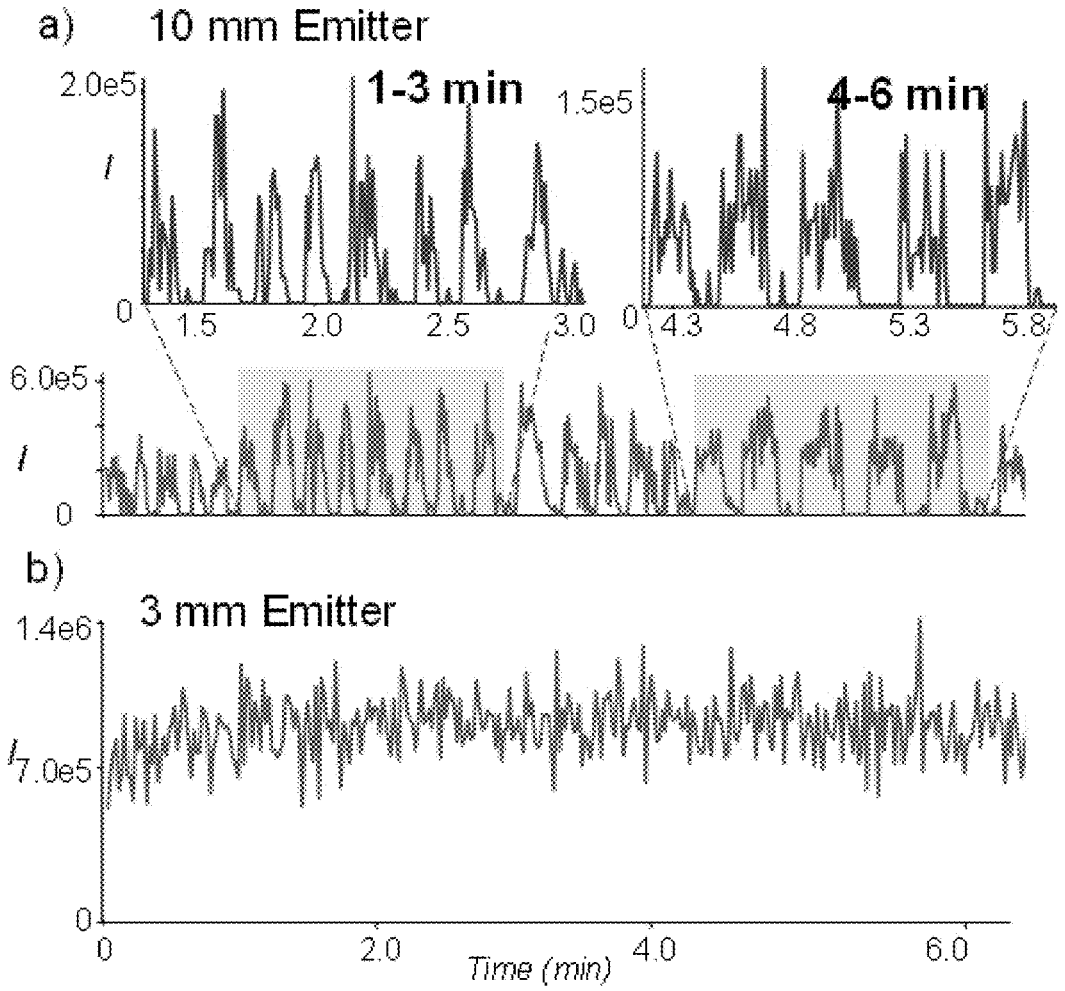
FIG. 8 panel A shows an ion chronogram recorded using a 10 mm capillary on paper substrate, SRM analysis m/z 455→165 for verapamil 100 ng/mL in bovine whole blood.

The impact by the extension of the capillary emitter out of the substrate was also investigated. Two paper-capillary devices were made, one with the emitter length of 3 mm and another one of 10 mm. A comparison was made between them for analysis of therapeutic drug compounds in dried blood spots on the paper substrates, each made by deposition of 3 μL blood samples. MeOH:$H_2O$ (9:1, v:v) of 100 μL, was applied on the paper substrate for each analysis and the QTrap 4000 with curtain gas at the atmospheric pressure interface was used for the MS analysis. FIG. 8 panel A shows the ion chronogram recorded for analysis of 100 ng/mL verapamil using SRM (single ion monitoring) of m/z 465→165, for which the paper-capillary device with 10 mm emitter was used. A pulsed pattern was observed for the ion signal recorded continuously. The width of the pulse became wider, from 12 s at the $1^{st}$ minute to 20 s at the $6^{th}$ minute of the spray. However, this was not observed when an emitter of 3 mm was used. An exemplary ion chronogram recorded for analysis of 100 ng/mL amitriptyline using SRM m/z 278→233 is shown in FIG. 8 panel B. The pulsed spray pattern observed with the 10 mm emitter suggests that the consumption of the solvent at the emitter tip outgoes the supply of the solvent wicking through the paper substrate. The long extension of the emitter broke the balance for the solvent delivery that was held for the direct paper spray or the paper-capillary spray with s short emitter. We have also tested the substrate with the 10 mm emitter using a TSQ, which has a heated capillary but no curtain gas at the inlet. Surprisingly, the pulsed pattern was not observed, which supports the hypothesis that a faster consumption facilitated by the curtain gas contributed to the discontinuous spray.

Figure 9:
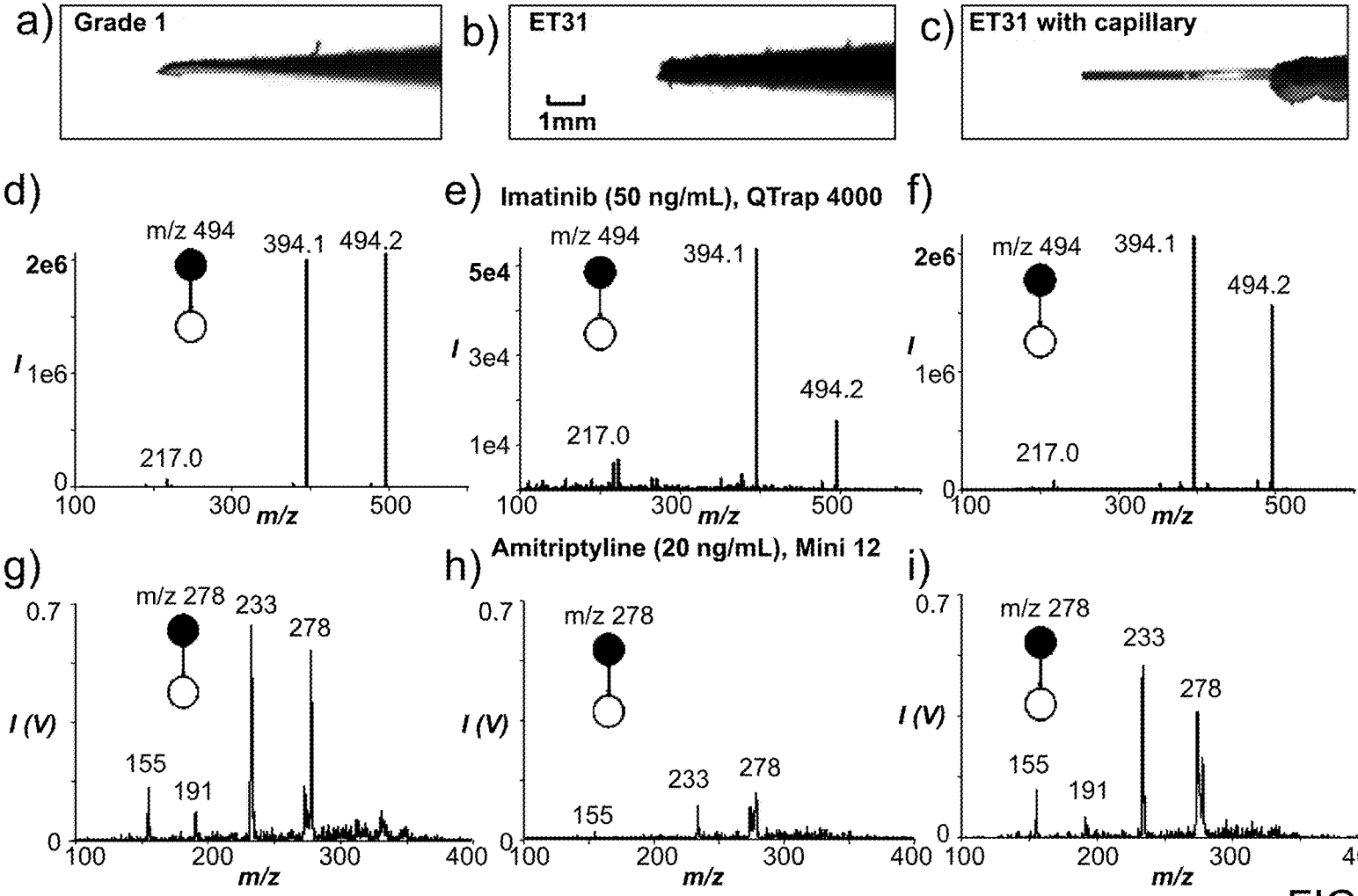
FIG. 9 panels A-C are photographs of of the emitting tips of the paper substrates and the paper-capillary device.
Figure 10:
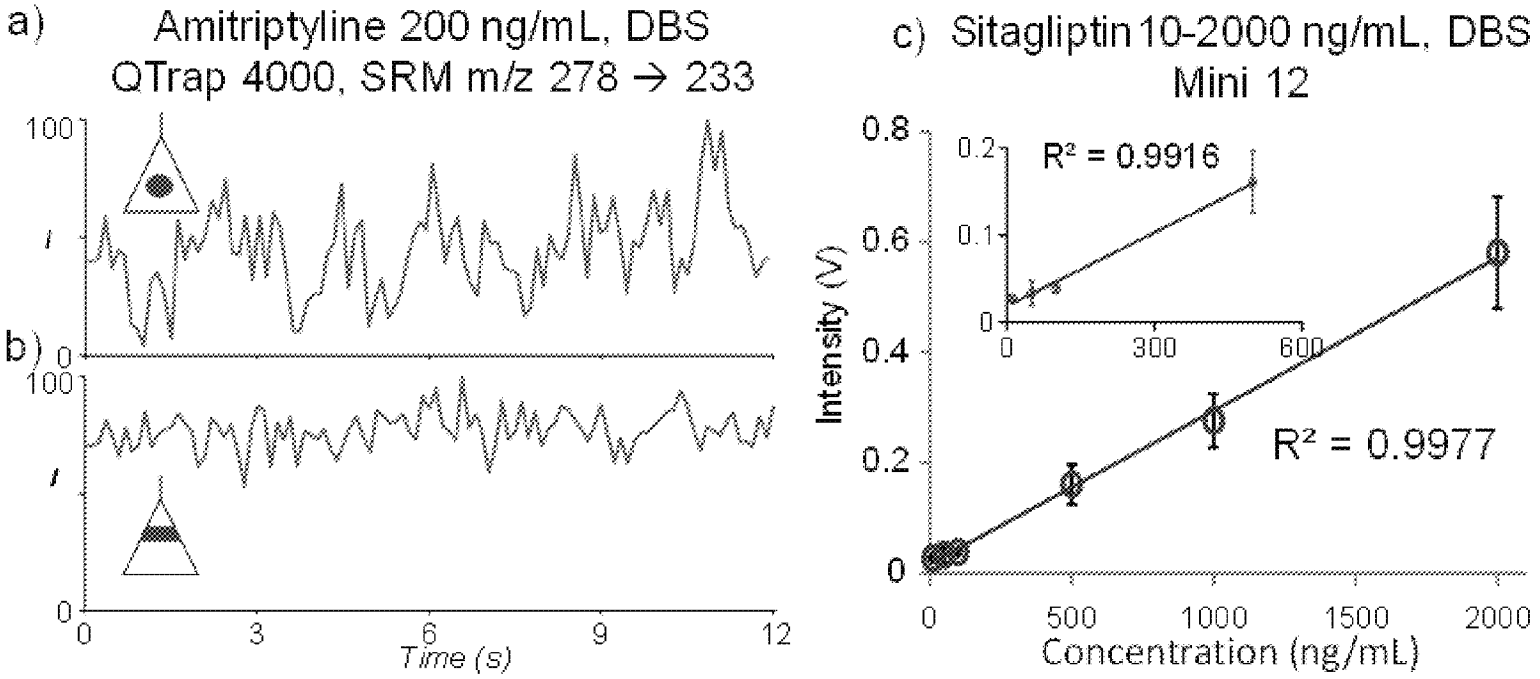
FIG. 10 panels A-B show ion chronograms recorded using QTrap 4000 with SRM transition m/z 278→233 for amitriptyline in blood, 200 ng/mL, using two different sample deposition methods.

After the optimization of the emitter on the substrate, a comparison of ionization efficiency was made among the paper sprays with the Grade 1 (0.18 mm thickness, FIG. 9 panel A), with ET 31 (0.5 mm thickness, FIG. 9 panel B), and the paper-capillary device with a 3 mm burnt emitter (FIG. 9 panel C). The spray solvent MeOH: $H_2O$ (9:1, v:v) containing a therapeutic drug was deposited on the substrates and the high voltage was applied to generate the spray ionization. The amount of solvent used for each analysis was 25 μL, for the Grade 1 paper spray substrate, but 70 μL for the ET 31 paper spray substrate and paper-capillary device, which also used the thicker ET31 paper as the substrate. The first comparison was done using QTrap 4000 to analyze the imatinib spiked in the spray solvent at 50 ng/mL. MS/MS analyses with precursor ion m/z 494 showed similar intensities of the fragment peaks for the Grade 1 paper spray substrate (FIG. 9 panel D) and the paper-capillary device (FIG. 9 panel F), but an intensity 50 time lower for ET 31 paper spray substrate (FIG. 9 panel E). Similar phenomenon was observed for analysis of amitriptyline at 20 ng/mL using Mini 12 (FIG. 9 panels G-I). The intensity obtained for paper spray with ET 31 is much lower than those for Grade 1 paper spray or paper-capillary spray. The combination of the thick paper substrate with a capillary emitter represents a good strategy for cartridge design. Using ET 31 as the paper substrate, higher sample load can be used than for thinner substrate such as Grade 1. The poor ionization efficiency related to the paper thickness, however, can now be solved with the capillary emitter. During the systematic characterization of paper-capillary spray, it was noticed that the signal intensity monitored for the analyte ion fluctuated significantly from scan to scan, regardless the improvement in the average intensity. It turned out that the method of sample deposition had an unexpected influence on the stability of the analyte signals. As shown in FIG. 10 panel A, the blood sample was originally deposited at the center of the paper substrate to form a DBS, as how it was done for paper spray. However, the scan-to-scan signal fluctuation was much more severe than the paper spray. An exemplary ion chronogram recorded for SRM analysis of amitriptyline 100 ng/mL in bovine whole blood using QTrap 4000 is shown in FIG. 10 panel A. MeOH:$H_2O$ (9:1, v:v) of 100 μL, was applied on the paper substrate for analyte extraction and spray ionization. Fragmentation transition m/z 278→233 was monitored. In contrast, when the sample was deposited in the form of an edge-to-edge band, the stability of the analyte signal was significantly improved (FIG. 10 panel B). The extraction solvent was applied at the base of the triangle paper substrate and wicked toward the tip; therefore, all the solvent would be forced to pass through the blood sample if it was deposited in an edge-to-edge band. This would improve the consistency of the concentration of the analytes in the spray solvent reaching the capillary emitter.

With the improved spray stability, the quantitative performance of paper capillary spray was evaluated for analysis of sitagliptin (JANUVIA) in blood using Mini 12. Samples with sitagliptin in bovine whole blood at 10, 50, 100, 500, 1000 and 2000 ng/mL were prepared for establishing a calibration curve. Blood sample of 3 μL was used to prepared each DBS on the substrate and 75 μL MeOH:$H_2O$ (9:1, v:v) was used as the extraction and spray solvent for each analysis. MS/MS analysis with the protonated ion m/z 408 as the precursor was performed and the ion intensity of the fragment ion m/z 235 was plotted as a function of the concentration to establish the calibration curve as shown in FIG. 10 panel C. The linear range well covers the therapeutic window of sitagliptin (16-200 ng/mL) with RSDs better than 25% achieved.

The ultimate solution for applying MS analysis in POC applications will be dependent on the combination of a direct sampling device and a miniaturized system. Development of disposable sample cartridges suitable for ambient ionization is a promising direction for performing MS analysis with simple protocols. The paper-capillery spray inherits the features of paper spray for simple sampling and fast analyte extraction, but also takes the advantage of the high ionization efficiency and reproducibility for spray off a glass emitter as for the traditional nanoESI. This study provides a promising solution to future design of disposable sample cartridges for analyzing biofluid samples using miniature MS systems with atmospheric pressure interfaces.

Example 3

Analysis of Compounds Using Probes of the Invention

Referring now to FIG. 3, which shows an analysis of cocaine, 50 ng/mL, in bovine blood using a device similar to that in FIG. 1 panel B and a TSQ Mass Spectrometer (Thermo Scientific, San Jose, Calif.). Whatman 31ET paper of 0.4 mm thickness was used to make the substrate of a trapezoidal shape. 8 mm of fuse silica capillary (49 μm i.d. and 150 μm o.d.) was inserted into the substrate at a depth of about 3 mm. 5 μL of blood sample was loaded onto the paper substrate for form a dried blood spot. 30 μL of methanol was applied onto the substrate for analyte extraction and spray ionization. 3000 V was applied to induce the spray. a) The extracted ion chronogram recorded with SRM transition m/z 304 to 182. b) The MS/MS spectrum of precursor m/z 304.

Referring now to FIG. 4, which shows an analysis of cocaine, 10 ng/mL, and verapamil, 30 ng/ml, in methanol solution using a device similar to that in FIG. 1 panel A and a Mini 12 mass spectrometer. Whatman 31ET paper of 0.4 mm thickness was used to make the substrate of a trapezoidal shape. 8 mm of fuse silica capillary (49 μm i.d. and 150 μm o.d.) was inserted into the substrate at a depth of about 2 mm. 15 μL of sample was loaded onto the paper substrate. 3000 V was applied to induce the spray. Dual-notch SWIFT wave form was applied to isolate both precursor ions m/z 304 and m/z 455; dual-frequency AC signal was applied to excite both precursors for CID. The MS/MS spectrum was recorded.

Referring now to FIG. 5, which is shows an analysis of cocaine, 50 ng/mL, in bovine blood using a device similar to that in FIG. 1 panel B and a Mini 12 mass spectrometer. Whatman 31ET paper of 0.4 mm thickness was used to make the substrate of a trapezoidal shape. 8 mm of fuse silica capillary (49 μm i.d. and 150 μm o.d.) was inserted into the substrate at a depth of about 2 mm. 5 μL of blood sample was loaded onto the paper substrate for form a dried blood spot. 30 μL of methanol was applied onto the substrate for analyte extraction and spray ionization. 3000 V was applied to induce the spray. Figure shows the MS/MS spectrum of precursor m/z 304.

What is claimed is:

1. A probe comprising a paper porous material and a hollow member inserted into a distal portion of the paper porous material, wherein the hollow member is composed of a non-paper material.

2. The probe according to claim 1, wherein the hollow member is a capillary tube.

3. The probe according to claim 1, wherein the porous material is paper.

4. The probe according to claim 1, wherein the hollow member extends beyond a distal end of the porous material.

5. The probe according to claim 1, wherein a distal end of the hollow member is smoothed.

6. The probe according to claim 1, wherein the porous materials further comprises one or more chemicals as internal standards or for on-line chemical derivatization.

7. A cartridge comprising:

a housing with an open distal end; and a probe situated within the housing, the probe comprising a paper porous material and a hollow member inserted into a distal portion of the paper porous material and operably aligned to the open distal end of the housing, wherein the hollow member is composed of a non-paper material.

8. The cartridge according to claim 7, wherein the housing comprises an opening to a porous material of the probe such that a sample can be introduced to the probe.

9. The cartridge according to claim 8, wherein the housing comprises a coupling for an electrode, such that an electric field can be applied to the probe.

10. The cartridge according to claim 8, further comprises a plurality of prongs that extend from the open distal end of the housing.

11. The cartridge according to claim 10, further comprising a solvent reservoir.

12. The cartridge according to claim 7, wherein the cartridge is operably associated with a mass spectrometer that is a bench top mass spectrometer or a miniature mass spectrometer.

13. The cartridge according to claim 12, wherein the mass spectrometer comprises a curtain gas.

14. A method for analyzing a sample, the method comprising:

providing a probe comprising a paper porous material and a hollow member inserted into a distal portion of the paper porous material, wherein the hollow member is composed of a non-paper material;

contacting a sample to the paper porous material;

generating ions of the sample from the probe that are expelled from a distal end of the hollow member; and analyzing the ions.

15. The method according to claim 14, wherein the generating step comprises applying a solvent and an electric field to the probe.

16. The method according to claim 15, wherein the wherein the mass spectrometer is a bench top mass spectrometer or a miniature mass spectrometer.

17. The method according to claim 14, wherein analyzing comprises introducing the ions into a mass spectrometer.

18. The method according to claim 14, wherein the sample is a biological sample.

* * * * *